US006641973B1

(12) United States Patent
Dontula et al.

(10) Patent No.: US 6,641,973 B1
(45) Date of Patent: Nov. 4, 2003

(54) PHOTOGRAPHIC DAY/NIGHT DISPLAYS UTILIZING INORGANIC PARTICLES

(75) Inventors: Narasimharao Dontula, Rochester, NY (US); Robert P. Bourdelais, Pittsford, NY (US); Debasis Majumdar, Rochester, NY (US); Cheryl J. Kaminsky, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/265,552

(22) Filed: Oct. 7, 2002

(51) Int. Cl.[7] ..... G03C 1/765; G03C 1/795; G03O 1/825; B41J 2/01

(52) U.S. Cl. ..... 430/201; 430/496; 430/523; 430/531; 430/502; 430/506; 430/507; 430/533; 430/536; 347/105

(58) Field of Search ..... 430/496, 531, 430/523, 533, 536, 502, 201, 506, 507; 347/105

(56) References Cited

U.S. PATENT DOCUMENTS

| | | | | |
|---|---|---|---|---|
| 4,739,007 | A | 4/1988 | Okada et al. | 524/710 |
| 4,810,734 | A | 3/1989 | Kawasumi et al. | 524/714 |
| 4,894,411 | A | 1/1990 | Okada et al. | 524/710 |
| 5,102,948 | A | 4/1992 | Deguchi et al. | 524/445 |
| 5,164,440 | A | 11/1992 | Deguchi et al. | 524/445 |
| 5,164,460 | A | 11/1992 | Yano et al. | 524/445 |
| 5,248,720 | A | 9/1993 | Deguchi et al. | 524/445 |
| 5,552,469 | A | 9/1996 | Beall et al. | |
| 5,578,672 | A | 11/1996 | Beall et al. | |
| 5,698,624 | A | 12/1997 | Beall et al. | |
| 5,721,306 | A | 2/1998 | Tsipursky et al. | |
| 5,804,613 | A | 9/1998 | Beall et al. | 524/445 |
| 5,830,528 | A | 11/1998 | Beall et al. | 524/445 |
| 5,854,326 | A | 12/1998 | Sakaya et al. | 524/445 |
| 6,017,685 | A | 1/2000 | Bourdelais et al. | 430/536 |
| 6,030,756 | A | 2/2000 | Bourdelais et al. | 430/536 |
| 6,034,163 | A | 3/2000 | Barbee et al. | |
| 6,352,822 | B1 * | 3/2002 | Camp et al. | 430/502 |
| 6,355,404 | B1 | 3/2002 | Camp et al. | 430/536 |
| 6,475,696 | B2 * | 11/2002 | Majumdar et al. | 430/536 |
| 2002/0123015 | A1 * | 9/2002 | Majumdar et al. | 430/523 |

FOREIGN PATENT DOCUMENTS

| | | |
|---|---|---|
| JP | 3-62846 | 3/1991 |
| JP | 7-166036 | 6/1995 |
| JP | 8-73710 | 3/1996 |
| JP | 8-120071 | 5/1996 |
| WO | 93/04118 | 3/1993 |
| WO | 94/04961 | 3/1994 |

OTHER PUBLICATIONS

Pending U.S. Ser. No. 09/751,192, Majumdar et al., *Imaging Elements with Nanocomposite Containing Supports*, filed Dec. 28, 2000.

Pending U.S. Ser. No. 10/011/040, Dontula et al., *Ethoxylated Alcohol Intercalated Smectite Materials And Method*, filed Nov. 13, 2001.

Pending U.S. Ser. No. 10/008/810, Majumdar et al., *Smectite Clay Intercalated With Polyether Block Polyamide Copolymer*, filed Nov. 13, 2001.

Pending U.S. Ser. No. 10/006,545, Nair et al., *Polyester Nanocomposites*, filed Nov. 13, 2001.

Pending U.S. Ser. No. 10/008/428, Dontula et al., *Article Utilizing Block Copolymer Intercalated Clay*, filed Nov. 13, 2001.

* cited by examiner

*Primary Examiner*—Richard L. Schilling
(74) *Attorney, Agent, or Firm*—Lynne M. Blank

(57) ABSTRACT

The invention relates to an imaging member comprising a duplitized imaging layer and a support comprising at least one layer comprising an inorganic particle having an aspect ratio of at least 10 to 1, a lateral dimension of from 0.01 $\mu$m to 5 $\mu$m, and a vertical dimension from 0.5 nm to 10 nm, and polymeric resin matrix.

31 Claims, No Drawings

PHOTOGRAPHIC DAY/NIGHT DISPLAYS UTILIZING INORGANIC PARTICLES

CROSS REFERENCE TO RELATED APPLICATIONS

Reference is made to commonly assigned, co-pending U.S. Patent Applications:

Ser. No. 10/266,181 by Bourdelais et al., filed of even date herewith entitled "Optical Element Containing Nano-composite Materials";

Ser. No. 10/266,176 by Kaminsky et al. filed of even date herewith entitled "Voided Polymer Film Containing Layered Particulates";

Ser. No. 10/265,974 by Dontula et al., filed of even date herewith entitled "Optical Element Containing Nano-Composite Particles", a continuation-in-part of Ser. No. 10/216,121 filed Aug. 9, 2002 entitled "Bulk Light Containing Nano-Composite Materials"; and Ser. No. 10/265,982 by Aylward et al., filed of even date herewith entitled "Waveguide with Nanoparticle Induced Refractive Index Gradient", the disclosures of which are incorporated herein.

FIELD OF THE INVENTION

The present invention relates to a novel translucent nano-composite support for use in photographic reflection and transmission imaging applications.

BACKGROUND OF THE INVENTION

It is known in the art that photographic display materials are utilized for advertising, as well as decorative displays of photographic images. Since these display materials are used in advertising, the image quality of the display material is critical in expressing the quality message of the product or service being advertised. Further, a photographic display image needs to be high impact, as it attempts to draw consumer attention to the display material and the desired message being conveyed. Typical applications for display material include product and service advertising in public places such as airports, buses and sports stadiums, movie posters, and fine art photography. The desired attributes of a quality, high impact photographic display material are a slight blue density minimum, durability, sharpness, and flatness. Cost is also important, as display materials tend to be expensive compared with alternative display material technology such as lithographic images on paper. For display materials, traditional color paper is undesirable, as it suffers from a lack of durability for the handling, photo processing, and display of large format images.

Prior art photographic display materials historically have been classified as either reflection or transmission. Reflection display material typically is highly pigmented image supports with a light sensitive silver halide coating applied. Reflection display materials are typically used in commercial applications where an image is used to convey an idea or message. An application example of a reflection display material is product advertisement in a public area. Prior art reflection display materials have been optimized to provide a pleasing image using reflective light. Transmission display materials are used in commercial imaging applications and are typically backlit with a light source. Transmission display materials are typically a clear support with a light sensitive silver halide and an incorporated diffuser (to hide the "show through" of the lamps used to provide viewing illumination) or a substantially transparent support coated with a light sensitive silver halide emulsion which requires a diffusing screen to be placed behind the material as a means to obscure the "show through" of the lamps used to provide illumination to the media. Prior art transmission display materials have been optimized to provide a pleasing image when the image is backlit with a variety of light sources. Because prior art reflection and transmission products have been optimized to be either a reflection display image or a transmission display image, two separate product designs must exist in manufacturing, and two inventories of display materials must be maintained at the photofinishing printing site. Further, the quality of the backlighting for transmission display material is diminished when, for example, a backlight burns out or the output of the backlight decreases with the age, the transmission image will appear dark and reduce the commercial value of the image. It would be desirable if an image support could function both as a reflection and transmission display material.

Prior art transmission display materials use a high coverage of light sensitive silver halide emulsion to increase the density of the image compared to photographic reflection print materials. While increasing the coverage does increase the density of the image in transmission space, the time to image development is also increased as the coverage increases. Typically, a high-density transmission display material has a developer time of at least 110 seconds compared to a developer time of 45 seconds or less for photographic print materials. Prior art high-density transmission display materials, when processed, reduce the productivity of the development lab. Further, coating a high coverage of emulsion requires additional drying of the emulsion in manufacturing, which reduces the productivity of emulsion coating machines. It would be desirable if a transmission display material was high in density and had a developer time less than 50 seconds.

Prior art reflection photographic materials with a polyester base use a $TiO_2$ pigmented polyester base onto which light sensitive silver halide emulsions are coated. It has been proposed in WO 94/04961 to use opaque polyester containing 10% to 25% $TiO_2$ for a photographic support. The $TiO_2$ in the polyester gives the reflection display materials an undesirable opalescent appearance. The $TiO_2$ pigmented polyester also is expensive because the $TiO_2$ must be dispersed into the entire thickness, typically from 100 to 180 $\mu$m. The $TiO_2$ used in this fashion gives the polyester support a slight yellow tint, which is undesirable for a photographic display material. For use as a photographic display material, the polyester support containing $TiO_2$ must be tinted blue to offset the yellow tint of the polyester, causing a loss in desirable whiteness and adding cost to the display material.

Prior art photographic display material uses polyester as a base for the support. Typically the polyester support is from 150 to 250 $\mu$m thick to provide the required stiffness. Prior art photographic display materials are typically coated with light sensitive silver halide imaging layers on one side of the support. Exposure devices have been built to expose only one side of prior art display materials, thus there is little concern for print platen design. For example, exposure devices that use a vacuum roll for holding the media during exposing typically employ slots for vacuum. These slots act as "black traps" (areas where exposing energy will be lost and have little secondary reflection) which in a duplitized emulsion system will result in uneven density for the backside image.

In U.S. Pat. No. 6,030,756 duplitized silver halide imaging layers are discussed for use as a display material. In U.S.

Pat. No. 6,030,756, both the top and bottom images are exposed by exposing the topside silver halide imaging layers. While the display material in U.S. Pat. No. 6,030,756 forms an excellent image capable of an exceptional reflection and transmission image, the display material in U.S. Pat. No. 6,030,756 suffers from uneven backside image density when placed against a non-uniform reflecting platen and subsequently exposed with light energy.

It has been found that the prior art structure disclosed in U.S. Pat. Nos. 6,030,756 and 6,017,685 is plagued with uneven density variations as a result of uncontrolled backscatter in certain printers in the absence of an antihalation layer. As is obvious, this undesirable exposure can be effectively controlled by the addition of an antihalation layer. However, the presence of an antihalation layer was found to give greatly diminished imaging efficiency, particularly in the backside imaging layer. In this case, the curve shape of an exposure versus density plot reveals a significant break at the mid-scale that leads to significantly lower shoulder and maximum density, as compared to an element without the antihalation layer. Although in principle it may be possible to recover this density with the addition of silver and coupler to the backside imaging layers, this would be very undesirable on a material cost basis and also due to the desire to keep the required photo processing time to a minimum.

U.S. Pat. No. 6,355,404 discloses a duplitized photographic display material containing a voided polyester base material that diffuses the front image from the back image in reflective viewing thus allowing the image to be high in quality compared to prior art display material. While the voided polyester base disclosed in U.S. Pat. No. 6,355,404 does diffuse the front image from the back image, a base material with a higher light transmission would allow the image to be brighter in both reflection viewing and transmission viewing.

Ever since the seminal work conducted at Toyota Central Research Laboratories, polymer-clay nanocomposites have generated a lot of interest across industry. The utility of inorganic nanoparticles as additives to enhance polymer performance has been well established. Over the last decade or so, there has been an increased interest in academic and industrial sectors towards the use of inorganic nanoparticles as property enhancing additives. The unique physical properties of these nanocomposites have been explored by such varied industrial sectors as the automotive industry, the packaging industry, and plastics manufactures. These properties include improved mechanical properties, such as elastic modulus and tensile strength, thermal properties such as coefficient of linear thermal expansion and heat distortion temperature, barrier properties, such as oxygen and water vapor transmission rate, flammability resistance, ablation performance, or solvent uptake. Some of the related prior art is illustrated in U.S. Pat. Nos. 4,739,007; 4,810,734; 4,894,411; 5,102,948; 5,164,440; 5,164,460; 5,248,720; 5,854,326; and 6,034,163.

In general, the physical property enhancements for these nanocomposites are achieved with less than 20 vol. % addition, and usually less than 10 vol. % addition of the inorganic phase, which is typically clay or organically modified clay. Although these enhancements appear to be a general phenomenon related to the nanoscale dispersion of the inorganic phase, the degree of property enhancement is not universal for all polymers. It has been postulated that the property enhancement is very much dependent on the morphology and degree of dispersion of the inorganic phase in the polymeric matrix.

The clays in the polymer-clay nanocomposites are ideally thought to have three structures: (1) clay tactoids wherein the clay particles are in face-to-face aggregation with no organics inserted within the clay lattice; (2) intercalated clay wherein the clay lattice has been expanded to a thermodynamically defined equilibrium spacing due to the insertion of individual polymer chains, yet maintaining a long range order in the lattice; and (3) exfoliated clay wherein singular clay platelets are randomly suspended in the polymer, resulting from extensive penetration of the polymer into the clay lattice and its subsequent delamination. The greatest property enhancements of the polymer-clay nanocomposites are expected with the latter two structures mentioned herein above.

Clays are hydrophilic hence they are not compatible with most organic molecules, specifically the hydrophobic thermoplastic polymers. There has been considerable effort put towards developing materials and methods for dispersing and compatibilizing nanoclays in polymers like polyesters. This is because polyesters are plastics which are used in large volume in fibers, films, food and beverage containers and engineering applications. Some of the polyesters of most commercial interest are poly(ethylene terepthalate) (PET), poly(butylene terepthalate) (PBT), poly(ethylene napthalate) (PEN) and amorphous glycol modified PET (PETG). Preparation techniques for polyester-clay nanocomposites can be divided into two broad categories. One category is called in-situ incorporation or in-situ polymerization where the smectite clays are treated and added during polymerization. The clays may be added along with the monomers or during the polymerization process. The other category is to melt mix polyesters with treated clays by a compounding process.

The monomers for polyesters are polar. During the polymerization process, the polarity decreases as the molecular weight increases, phase separation of clay and polymer occurs. Hence compatibility between the clays and polymer is important. To enhance the compatibility of the clays, two general routes exist for in-situ clay incorporation. The first is based on a novel technology developed by AMCOL international corporation as disclosed in U.S. Pat. Nos. 5,578,672; and 5,721,306 where clays treated with a polar polymer like poly(vinylpyrrolidone) (PVP) or poly (vinylalcohol) (PVOH) are exfoliated into ethylene glycol, a monomer for PET. This exfoliation of clay is maintained during polymerization process by altering the polymerization conditions. Eastman Chemical (WO 98/29499) used a similar clay modification technique and introduced directly into the charge of a PET melt polymerization with DMT to prepare PET nanocomposites having an improved oxygen barrier. The other route is in-situ incorporation of an organoclay or synthetic clay or sintered clay like fluoromica (JP 8-73710, JP 8-120071). Organoclays are typically prepared using the ion exchange method where onium ions (JP 3-62846) or ammonium salts (JP 7-166036) are used to expand the clay.

In the melt compounding process, the resin is melt mixed with organoclays (WO 93/04118), synthetic clays or clays modified by a technique developed by AMCOL international corporation (vide, for example, U.S. Pat. Nos. 5,552,469; 5,578,672; 5,698,624; 5,804,613; and 5,830,528). U.S. Pat. No. 5,552,469 discusses a technique for dispersing clays in a water soluble polymer like PVP, PVOH which is then dried, and then melt mixed in a thermoplastic resin. U.S. Pat. No. 5,578,672 discusses a process of modifying clays by mixing it with water and polymer with functional groups. This is then dried and mixed with polymer resins. U.S. Pat.

No. 5,698,624 discusses use of monomers with benzene ring, hydroxyl group, carboxyl group or low molecular weight polymers to intercalate clays using nonaqueous solvents. This is then later mixed with polymers like polyesters. U.S. Pat. Nos. 5,804,613 and 5,830,528 discuss a similar method of intercalating clays but with different functional monomers in presence of water, prior to mixing the dried clays with the thermoplastics.

In order to further facilitate delamination and prevent reaggregation of the clay particles, these intercalated clays are required to be compatible with the matrix polymer in which they are to be incorporated. This can be achieved through the careful selection and incorporation of compatibilizing or coupling agents, which consist of a portion which bonds to the surface of the clay and another portion which bonds or interacts favorably with the matrix polymer. Compatibility between the matrix polymer and the clay particles ensures a favorable interaction which promotes the dispersion of the intercalated clay in the matrix polymer. Effective compatibilization leads to a homogenous dispersion of the clay particles in the typically hydrophobic matrix polymer and/or an improved percentage of exfoliated or delaminated clay. Typical agents known in the art include general class of materials such as organosilane, organozirconate and organotitanate coupling agents. However, the choice of the compatibilizing agent is very much dependent on the matrix polymer as well as the specific component used to intercalate the clay, since the compatibilizer has to act as a link between the two.

A survey of the art makes it clear that there is a lack of general guideline for the selection of the intercalating and compatibilizing agents for a specific matrix polymer and clay combination. Even if one can identify these two necessary components through trial and error, they are usually incorporated as two separate entities, usually in the presence of water followed by drying, in a batch process and finally combined at a separate site with the matrix polymer during melt-processing of the nanocomposite. Such a complex process obviously adds to the cost of development and manufacturing of the final product comprising such a nanocomposite. There is a critical need in the art for a comprehensive strategy for the development of better materials and processes to overcome some of the aforementioned drawbacks.

Imaging elements such as photographic elements usually comprise a flexible thermoplastic base on which is coated the imaging material such as the photosensitive material. The thermoplastic base is usually made of polymers derived from the polyester family such as polyethylene terephthalate (PET), polyethylene naphthalate (PEN) and cellulose triacetate (TAC). Films for color and black and white photography, and motion picture print film are examples of imaging media comprising such flexible plastic bases in roll form. TAC has attributes of high transparency and curl resistance after processing but poor mechanical strength. PET on the other hand has excellent mechanical strength and manufacturability but undesirable post process curl. The two former attributes make PET more amenable to film thinning, enabling the ability to have more frames for the same length of film. Thinning of the film however causes loss in mechanical strength. The stiffness will drop as the cube root of the thickness of the film. Also a photosensitive material coated on the base in a hydrophilic gelatin vehicle will shrink and curl towards the emulsion when dry. There is hence a need for a base that is thinner yet stiff enough to resist this stress due to contraction forces. Further, in motion picture print film image distortion arises from thermal buckle of the plastic film caused by the heat generated by the projector bulb. Hence a transparent film base that has dimensional stability at high temperatures due to its higher heat capacity is also highly desirable.

PROBLEM TO BE SOLVED BY THE INVENTION

There is a continuing need for an improved product that will present a bright reflective image when viewed directly and also provide a sharp bright image of sufficient dye density when back illuminated.

SUMMARY OF THE INVENTION

The present invention relates to an imaging member comprising at least one duplitized imaging layer and a support, wherein the support comprises at least one layer comprising a polymeric resin matrix and an inorganic particle having an aspect ratio of at least 10 to 1, a lateral dimension of between 0.01 $\mu$m and 5 $\mu$m, and a vertical dimension between 0.5 nm and 10 nm, wherein said support comprises a top surface and a bottom surface.

ADVANTAGEOUS EFFECT OF THE INVENTION

The invention provides a material that will, when imaged and developed, result in a bright sharp reflective image when viewed in ambient front surface lighting conditions, as well as allowing for a pleasing image of sufficient dye density when illuminated with a transmission light source. In a preferred form the invention provides a product that may be provided with a silver halide image on each side but still retain a single exposure step and short processing time.

DETAILED DESCRIPTION OF THE INVENTION

The invention has numerous advantages over prior display materials and methods of imaging display materials, although not all advantages may be reflected in a single embodiment. The present invention comprises a superior, lower cost, and stronger display material which provides a backside image of sufficient dye density when the only exposing light is on the front side of the display element. The support comprises an inorganic particle compatible with a matrix polymer, preferably polyester, in which the particle, preferably a splayed clay, can be dispersed. In one embodiment, the invention provides an article comprising a matrix polymer and an intercalated clay wherein the intercalated clay comprises a matrix compatible component. The display materials of the invention provide very efficient diffusing of light while allowing the transmission of a high percentage of the light. In one embodiment, the layers of the extruded polymer sheet of this invention have levels of nanocomposite material of a splayed inorganic particle and resin matrix, optical brightener, and colorants adjusted to provide optimum transmission and reflection properties. In another embodiment, a polymer sheet has a nanocomposite layer of a splayed inorganic particle and resin matrix to efficiently diffuse the illuminating light source common with transmission display materials without the use of expensive $TiO_2$ or other white pigments. In another embodiment, the invention materials provide a splayed clay which can be effectively incorporated to form a polymer-clay nanocomposite. The matrix polymer of interest are polyesters. Such polyester-inorganic particle nanocomposites can be further incorporated in an article of engineering application with improved physical properties such as improved modulus, tensile strength, toughness, impact resistance, electrical conductivity, heat distortion temperature, coefficient of linear thermal expansion, fire retardance, oxygen and water vapor barrier properties, all of which have significant commercial value in for display materials.

The support of this invention, which in a preferred embodiment comprises at least one sheet, is also low in cost, as the functional layer may be coextruded at the same time, avoiding the need for further processing such as lamination, priming, or extrusion coating. The materials are low in cost as the polyester base layer, preferably extruded, is made in one step. Prior art products are typically a two step process or incorporate a bottom pigmented layer coating which adds to the drying load and slows the coating process down. The formation of transmission display materials requires a display material that diffuses light so well that individual elements of the illuminating bulbs utilized are not visible to the observer of the displayed image. On the other hand, it is necessary that light be transmitted efficiently to brightly illuminate the display image. The invention allows a greater amount of illuminating light to actually be utilized as display illumination while at the same time very effectively diffusing the light sources such that they are not apparent to the observer. The display material of the invention will appear whiter to the observer than prior art materials which have a tendency to appear somewhat yellow as they require a high amount of light scattering pigments to prevent the viewing of individual light sources. These high concentrations of pigments appear yellow to the observer and result in an image that is darker than desirable.

The display material contains in one of its preferred forms silver halide imaging layers on both sides of a polymer sheet and may be imaged by a collimated beam exposure device in a single exposure. As there are two relatively thin layers of silver halide image materials, the developing of the invention element may be carried out rapidly as the penetration of the developing solution is rapid through the thin layers of imaging material, allowing greater productivity in a commercial printing lab. The material of the invention is robust to exposure devices, as the materials added to the bottommost layers allows for different exposure devices to be utilized for the formation of quality images. The invention material allows for the simultaneous exposure of both the top and bottom imaging layers while preventing the effect of printer backscatter which would significantly degrade the quality of the image. The structure of the media allows for a pleasing reflection image when the image is captured in a light box containing an air gap from the illumination lamps used for transmission viewing, while also providing uniform diffusion of the transmission illumination source to provide a pleasing transmission image.

The preferred invention materials ensure that the speed of the front side and back side formed dye density after processing results in a differential speed of the two such that when measured by Status A transmission densitometry, there is presented a continuous and uninterrupted curve shape substantially free from non-uniformities caused by an incorrect speed offset of the front side and back side emulsions. A thinner base material is lower in cost and allows for roll handling efficiency as the rolls would weigh less and be smaller in diameter. It would be desirable to use a base material that had the required stiffness but was thinner to reduce cost and improve roll-handling efficiency.

Another embodiment of the invention has an additional advantage of splaying the inorganic particle with a block copolymer wherein one block is chosen to be a hydrophilic polymer which is capable of intercalating/exfoliating the inorganic particle. In the case of hydrophillic inorganic particle surfaces, this block has a natural affinity to the inorganic particle surface and can readily enter the inorganic particle lattice and splay, that is intercalate, exfoliate or both, the inorganic particle. The aforesaid block copolymer further comprises a matrix compatible block that is oleophilic. Such an example may be polyester. Such a design of the block copolymer ensures that a component of the block copolymer will splay the inorganic particle and another component, the matrix compatible block, will compatibilize the splayed inorganic particle with a hydrophobic matrix polymer. Thus, two necessary criteria of effectively dispersing inorganic particle in a polymer to form a desirable polymer-inorganic particle nanocomposite, namely inorganic particle intercalation and/or exfoliation and compatibilization, can be fulfilled by the choice of the block copolymer of this invention. The block copolymer, in essence, replaces two separate materials: inorganic particle splayant and compatibilizer.

Another advantage of one embodiment of the invention arises from the fact that the splayant, such as a block copolymer, can be incorporated in the inorganic particle in an essentially dry state (i.e., without involving any aqueous medium). This feature eliminates the need for a costly and time consuming drying step in the preparation of the splayed inorganic particle.

Another advantage of an embodiment of the invention derives from the fact that the inorganic particle, the splayant and the matrix polymer, preferably a polyester, can all be combined in a single step in a suitable compounder, thus, adding greatly to the efficiency of the manufacturing process.

Another advantage of an embodiment of the invention is that it teaches of a general strategy wherein the chemistry of the splayant can be tailored according to the choice of the inorganic particle and the specific matrix polymer. In an additional embodiment, the molecular weights and the ratios of the splayant, in the case of a block copolymer, the blocks, can be controlled easily to meet the processing conditions, such as temperature, shear, viscosity and product needs, such as various physical properties. These and other advantages will be apparent from the detailed description below.

Whenever used in the specification the terms set forth shall have the following meaning:

"Nanocomposite" means a composite material wherein at least one component comprises an inorganic phase, such as a smectite clay, with at least one dimension in the 0.1 to 100 nanometer range.

"Plates" means particles with two comparable dimensions significantly greater than the third dimension, e.g, length and width of the particle being of comparable size but orders of magnitude greater than the thickness of the particle.

"Layered material" means an inorganic material such as a smectite clay that is in the form of a plurality of adjacent bound layers.

"Platelets" means individual layers of the layered material.

"Intercalation" means the insertion of one or more foreign molecules or parts of foreign molecules between platelets of the layered material, usually detected by X-ray diffraction technique, as illustrated in U.S. Pat. No. 5,891,611 (line 10, col. 5–line 23, col. 7).

"Intercalant" means the aforesaid foreign molecule inserted between platelets of the aforesaid layered material.

"Exfoliation" or "delamination" means separation of individual platelets in to a disordered structure without any stacking order.

"Intercalated" refers to layered material that has at least partially undergone intercalation and/or exfoliation.

"Organoparticle" means a particle modified by organic molecules.

"Organoclay" means clay material modified by organic molecules.

"Splayed" layered material means layered materials which are completely intercalated with no degree of exfoliation, totally exfoliated materials with no degree of intercalation, as well as layered materials which are both intercalated and exfoliated including disordered layered materials.

"Splayant" means a material capable of splaying.

"Splaying" refers to the separation of the layers of a layered material, which may be to a degree which still maintains a lattice-type arrangement, as in intercalation, or a degree which spreads the lattice structure to the point of loss of lattice structure, as in exfoliation.

In order to provide an improved duplitized display material, the present invention comprises a imaging member comprising at least one duplitized imaging layer and a support comprising at least one layer, preferably extruded, comprising an inorganic particle having an aspect ratio of at least 10 to 1, a lateral dimension of from 0.01 $\mu$m to 5 $\mu$m, and a vertical dimension from 0.5 nm to 10 nm, and polymeric resin matrix. By providing a polymer material with an inorganic particle having an aspect ratio of at least 10 to 1, a lateral dimension of from 0.01 $\mu$m to 5 $\mu$m, and a vertical dimension from 0.5 nm to 10 nm, the support provides excellent diffusion of the front image and the back image in reflective viewing while allowing the two images to form sufficient dye density for an excellent image in transmission viewing of the image. The inorganic particles in the support provide for several index of refraction changes diffusing transmitted light while having a higher % light transmission than prior art voided polymer sheets utilizing organic void initiating particles in the voided layer allowing the image in both reflection and transmission to be brighter and sharper.

In order to provide an imaging material that can be viewed in both reflection and transmission a duplitized imaging layer comprises a top imaging layer on the top surface of the support and a bottom imaging layer on the bottom surface of the support. By applying imaging layers to both surfaces of the support of the invention, the image can be viewed in both reflection and transmisssion.

In a preferred embodiment of the invention, the support comprises at least one layer containing inorganic particles and polymeric resin matrix. The inorganic materials preferably are coated in a binder layer consisting of polymeric resin matrix. The polymeric resin matrix binder may be either solvent based or aqueous based. The coating method may be curtain coating, gravure coating, roll coating or air knife coating. The coated layer preferably is less than 5 micrometers. The polymeric resin matrix material preferably contains an high surface energy image adhesion layer for direct application of imaging layers such as silver halide or ink jet dye receiving layers.

The inorganic particle material suitable for this invention can comprise any inorganic material, preferably comprising layered materials in the shape of plates with significantly high aspect ratio. However, other shapes with high aspect ratio will also be advantageous, as per the invention. The layered materials most suitable comprise clay. The clay materials suitable for this invention include phyllosilicates, e.g., montmorillonite, particularly sodium montmorillonite, magnesium montmorillonite, and/or calcium montmorillonite, nontronite, beidellite, volkonskoite, hectorite, saponite, sauconite, sobockite, stevensite, svinfordite, vermiculite, magadiite, kenyaite, talc, mica, kaolinite, and mixtures thereof. Other useful layered materials include illite, mixed layered illite/smectite minerals, such as ledikite and admixtures of illites with the clay minerals named above. Other useful layered materials, particularly useful with anionic matrix polymers, are the layered double hydroxides or hydrotalcites, such as $Mg_6Al_{3.4}(OH)_{18.8}(CO_3)_{1.7}H_2O$, which have positively charged layers and exchangeable anions in the interlayer spaces. Other layered materials having little or no charge on the layers may be useful provided they can be intercalated with swelling agents, which expand their interlayer spacing. Such materials include chlorides such as $FeCl_3$, FeOCl, chalcogenides, such as $TiS_2$, $MoS_2$, and $MoS_3$, cyanides such as $Ni(CN)_2$ and oxides such as $H_2Si_2O_5$, $V_6O_{13}$, $HTiNbO_5$, $Cr_{0.5}V_{0.5}S_2$, $V_2O_5$, Ag doped $V_2O_5$, $W_{0.2}V_{2.8}O_7$, $Cr_3O_8$, $MoO_3(OH)_2$, $VOPO_4$—$2H_2O$, $CaPO_4CH_3$—$H_2O$, $MnHAsO_4$—$H_2O$, $Ag_6Mo_{10}O_{33}$. Preferred clays are swellable so that other agents, usually organic ions or molecules, can intercalate and/or-exfoliate the layered material resulting in a desirable dispersion of the inorganic phase. These swellable clays include phyllosilicates of the 2:1 type, as defined in clay literature (vide, for example, "An introduction to clay colloid chemistry," by H. van Olphen, John Wiley & Sons Publishers). Typical phyllosilicates with ion exchange capacity of 50 to 300 milliequivalents per 100 grams are preferred. Preferred clays for the present invention include smectite clay such as montmorillonite, nontronite, beidellite, volkonskoite, hectorite, saponite, sauconite, sobockite, stevensite, svinfordite, halloysite, magadiite, kenyaite and vermiculite as well as layered double hydroxides or hydrotalcites. Most preferred clays include montmorillonite, hectorite, mica and hydrotalcites, because of their effectiveness in the present invention and the commercial availability of these materials.

The aforementioned inorganic particle can be natural or synthetic, for example synthetic smectite clay. This distinction can influence the particle size and/or the level of associated impurities. Typically, synthetic inorganic particles, such as clays, are smaller in lateral dimension, and therefore possess smaller aspect ratio. However, synthetic inorganic particles are purer and are of narrower size distribution, compared to natural inorganic particles and may not require any further purification or separation. For this invention, the inorganic particle particles should have a lateral dimension of from 0.01 $\mu$m to 5 $\mu$m, and preferably from 0.05 $\mu$m to 2 $\mu$m, and more preferably from 0.1 $\mu$m to 1 $\mu$m. The thickness or the vertical dimension of the inorganic particle particles can vary from 0.5 nm to 10 nm, and preferably from 1 nm to 5 nm. The aspect ratio, which is the ratio of the largest and smallest dimension of the inorganic particle particles should be >10:1 and preferably >100:1 and more preferably >1000:1 for this invention. The aforementioned limits regarding the size and shape of the particles are to ensure adequate improvements in some properties of the nanocomposites without deleteriously affecting others. For example, a large lateral dimension may result in an increase in the aspect ratio, a desirable criterion for improvement in mechanical and barrier properties. However, very large particles can cause optical defects, such as haze, and can be abrasive to processing, conveyance and finishing equipment as well as the imaging layers.

The inorganic particle used in the invention may be an organically modified inorganic particle, i.e. an organoparticle. In the preferred embodiment the organoparticle comprises an be an organoclay, an organically modified clay particle. Organoclays are produced by interacting the unfunctionalized clay with suitable splayants, i.e. intercalants, exfoliants or both. These intercalants are typically organic compounds, which are neutral or ionic. Useful neutral organic molecules include polar molecules such as amides, esters, lactams, nitrites, ureas, carbonates, phosphates, phosphonates, sulfates, sulfonates, nitro compounds. The neutral organic intercalants can be monomeric, oligomeric or polymeric. Neutral organic molecules can cause intercalation in the layers of the clay through hydrogen bonding, without completely replacing the original charge balancing ions. Useful ionic compounds are cationic surfactants including onium species such as ammonium (primary, secondary, tertiary, and quaternary), phosphonium, or sulfonium derivatives of aliphatic, aromatic or arylaliphatic amines, phosphines and sulfides. Typically onium ions can cause intercalation in the layers through ion exchange with the metal cations of the preferred smectite clay. A number of commercial organoclays are available from clay vendors, which may be used in the practice of this invention.

Preferably the inorganic particles comprise from 2 to 15 parts by weight of the layer comprising inorganic particles and resin. Less than 1 part by weight does not provide sufficient diffusion in the support creating an unacceptably dark image in reflective viewing. At parts greater than 18, layer is too diffuse creating an unacceptably washed out image in transmission viewing. Further, the addition of greater than 20 parts has been shown to provide a native yellow color to the support interfering with the minimum density areas of the image. More preferably, inorganic particles comprise from 5 to 10 parts by weight of said at least one layer comprising inorganic particles inorganic particle and resin. The range from 5 to 10 parts as been shown to provide an acceptable image in both transmission and reflection viewing without significantly shifting the color of the image.

In another embodiment, the inorganic particle, preferably a clay splayed with an amphiphilic block copolymer. The amphiphilic block copolymer useful in the invention comprises a hydrophilic block capable of splaying the clay. The block copolymer further comprises a matrix compatible block that is an oleophilic polymer, and particularly suitable for polyester resins. In co-pending applications U.S. Ser. No. 10/011,040 (docket 82056), U.S. Ser. No. 10/008,810 (docket 82857), U.S. Ser. No. 10/006,545 (docket 82858) and U.S. Ser. No. 10/008,428 (docket 82859), incorporated herein by reference, details of organic materials, which can serve the dual purpose of intercalation and compatibilization of the clay in a polymeric matrix have been disclosed.

The block copolymers useful as splayants in the invention are amphiphilic and have a hydrophilic and an oleophilic component. Further, the block copolymers useful as splayants in the invention can be of the two block or "A-B" type where A represents the hydrophilic component and B represents the oleophilic component, or of the three block or "A-B-A" type. For example, the block copolymer may comprise three blocks and the matrix may comprise a copolymer or a blend of polymers compatible with at least one matrix compatible block of the copolymer. Also, where the matrix is a blend of polymers, individual polymers in the blend may be compatible with separate blocks of the copolymers. One presently preferred class of polymeric components that is useful for the hydrophilic component is poly (alkylene oxides) such as poly(ethylene oxide), because of their well-known ability to intercalate inorganic particle lattices, such as clay lattices, through hydrogen bonding and ionic interactions, as well as their thermal processability, and lubricity. The term poly(alkylene oxides) as used herein includes polymers derived from alkylene oxides such as poly(ethylene oxides) including mixtures of ethylene and propylene oxides. The most preferred is poly(ethylene oxide), mainly because of its effectiveness with the present invention, commercial availability in a range of molecular weights and chemistries affording a wide latitude in the synthesis of the block copolymers.

Poly(ethylene oxides) useful as splayants in the invention are well known in the art and are described in, for example U.S. Pat. No. 3,312,753 at column 4. Useful (alkylene oxide) block contains a series of interconnected ethyleneoxy units and can be represented by the formula:

$$\left[CH_2—CH_2—O\right]_n$$

wherein the oxy group of one unit is connected to an ethylene group of an adjacent ethylene oxide group of an adjacent ethyleneoxy unit of the series.

Other useful hydrophilic components include poly 6, (2-ethyloxazolines), poly(ethyleneimine), poly (vinylpyrrolidone), poly(vinyl alcohol), poly(vinyl acetate), polyacrylamides, polyacrylonitrile, polysaccharides and dextrans.

The oleophilic component or matrix compatible block useful as splayants in the present invention can also be selected from many common components. The oleophilic component is characterized in that it is at least partially miscible in the matrix polymer of the invention, and/or interacts with the matrix polymer, for example, through transesterfication. In the case of a polyester matrix, the matrix compatible block comprises polyester. Exemplary oleophilic components can be derived from monomers in such as: caprolactone; propiolactone; β-butyrolactone; δ-valerolactone; ϵ-caprolactam; lactic acid; glycolic acid; hydroxybutyric acid; acrylic, amide, derivatives of lysine; and derivatives of glutamic acid. Polymeric forms would include polycaprolactone; polypropiolactone; poly β-butyrolactone; poly δ-valerolactone; poly ϵ-caprolactam; poly lactic acid; poly glycolic acid; poly hydroxybutyric acid; polyacrylic, polyamide, poly derivatives of lysine; and poly derivatives of glutamic acid The molecular weights of the hydrophilic component and the oleophilic component of the splayant are not critical. A useful range for the molecular weight of the hydrophilic component is from 300 to 50,000 and preferably 1,000 and 25,000. The molecular weight of the oleophilic component is from 1,000 to 100,000 and preferably from 2,000 to 50,000. Preferably, the matrix compatible block will comprise 50 to 500 monomer repeat units. The preferred molecular weight ranges are chosen to ensure ease of synthesis and processing under a variety of conditions. Most preferably, these repeat units will comprise caprolactone in a polyester polymer matrix, to ensure compatibility.

For the practice of the present invention, it is important to ensure compatibility between the matrix polymer and at least one of the blocks of the copolymer used for splaying the inorganic particle. If the matrix polymer comprises a blend of polymers, the polymers in the blend should be compatible with at least one of the blocks of the copolymer used for splaying the inorganic particle. If the matrix polymer comprises copolymer(s), the copolymer(s) should be compatible with at least one of the blocks of the copolymer used for splaying the inorganic particle.

The matrix polymer of the invention can be any polymer but preferred to be thermoplastic polymers, copolymers or interpolymers and/or mixtures thereof, and vulcanizable and thermoplastic rubbers. The matrix polymer of choice for this invention belongs to the polyester family. The preferred polyesters are linear polyesters, because of their superior physical properties and processability.

The at least one layer comprising inorganic particles and resin preferably comprises a polyester resin. Polyester is preferred as it creates a support material that is tough and thin. In addition, it has been shown that the inorganic materials of the invention disperse and can be melt extrusion processed. Further, addenda such as blue tint, antistatic materials and polymer stabilizers can also be added to the polyester to improve image quality and function. In another preferred embodiment the resin of the invention is selected from the group consisting of polyolefin, polyamide, polystyrene, and polyurethane. Polyolefin resins are low in cost and have been shown to provide excellent adhesion between the imaging layers and the support material of the invention.

The type of polyester is not critical and the particular polyesters chosen for use in any particular situation will depend essentially on the physical properties and features, i.e., tensile strength, modulus, desired in the final form. Thus, a multiplicity of linear thermoplastic polyesters, including crystalline and amorphous polyesters, having wide variations in physical properties is suitable for use in the process of this invention.

The particular polyester chosen for use as the matrix polymer can be a homo-polyester or a co-polyester, or mixtures thereof as desired. Polyesters are normally prepared by the condensation of an organic dicarboxylic acid and an organic diols, and, therefore, illustrative examples of useful polyesters will be described herein below in terms of these diol and dicarboxylic acid precursors.

Polyesters which are suitable for use in this invention are those which are derived from the condensation of aromatic, cycloaliphatic, and aliphatic diols with aliphatic, aromatic and cycloaliphatic dicarboxylic acids and may be cycloaliphatic, aliphatic or aromatic polyesters. Exemplary of useful cycloaliphatic, aliphatic and aromatic polyesters which can be utilized in the practice of their invention are poly(ethylene terephthalate), poly (cyclohexlenedimethylene), terephthalate) poly(ethylene dodecate), poly(butylene terephthalate), poly(ethylene naphthalate), poly(ethylene(2,7-naphthalate)), poly (methaphenylene isophthalate), poly(glycolic acid), poly (ethylene succinate), poly(ethylene adipate), poly(ethylene sebacate), poly(decamethylene azelate), poly(ethylene sebacate), poly(decamethylene adipate), poly (decamethylene sebacate), poly(dimethylpropiolactone), poly(para-hydroxybenzoate) (Ekonol), poly(ethylene oxybenzoate) (A-tell), poly(ethylene isophthalate), poly (tetramethylene terephthalate, poly(hexamethylene terephthalate), poly(decamethylene terephthalate), poly(1,4-cyclohexane dimethylene terephthalate) (trans), poly (ethylene 1,5-naphthalate), poly(ethylene 2,6-naphthalate), poly(1,4-cyclohexylene dimethylene terephthalate), (Kodel) (cis), and poly(1,4-cyclohexylene dimethylene terephthalate (Kodel) (trans).

Polyester compounds prepared from the condensation of a diol and an aromatic dicarboxylic acid are preferred for use in this invention as matrix polymers because of their melt processability, strength and flexibility as substrates particularly for imaging elements. Illustrative of such useful aromatic carboxylic acids are terephthalic acid, isophthalic acid and a o-phthalic acid, 1,3-napthalenedicarboxylic acid, 1,4 napthalenedicarboxylic acid, 2,6-napthalenedicarboxylic acid, 2,7-napthalenedicarboxylic acid, 4,4'-diphenyldicarboxylic acid, 4,4'-diphenysulfphonedicarboxylic acid, 1,1,3-trimethyl-5-carboxy-3-(p-carboxyphenyl)-idane, diphenyl ether 4,4'-dicarboxylic acid, bis-p(carboxy-phenyl) methane. Of the aforementioned aromatic dicarboxylic acids, those based on a benzene ring (such as terephthalic acid, isophthalic acid, orthophthalic acid) are preferred for use in the practice of this invention. Amongst these preferred acid precursors, terephthalic acid is particularly preferred acid precursor because it leads to polyesters that are less prone to degradation during melt processing and more dimensionally stable.

Preferred polyesters for use in the practice of this invention include poly(ethylene terephthalate), poly(butylene terephthalate), poly(1,4-cyclohexylene dimethylene terephthalate) and poly(ethylene naphthalate), and copolymers and/or mixtures thereof. Among these polyesters of choice, PET is most preferred because of its effectiveness in the present invention, excellent mechanical strength and manufacturability.

Preferably the imaging element of the invention comprises a transparency of from 30 to 70% light transmission. Light transmission less than 25% is does not allow enough of the backside image to be viewed in transmission. Light transmission greater than 75% does not provide enough separation of the front image and the back image rendering a unacceptably dark image in reflective viewing. Most preferably, the imaging element of the invention comprises a transparency of from 45 to 55% light transmission. Transparency of from 45 to 55% light transmission as been shown to provide an acceptable image in both transmission and reflection viewing.

The total thickness of the support of the invention can range from 76 to 256 micrometers, preferably from 80 to 150 micrometers. Below 80 micrometers, the polyester base containing the clay diffuser layer may not be thick enough to minimize any inherent handling and kinking problems when handling large sheets of this material. At thickness higher than 150 micrometers, little improvement in either surface smoothness or mechanical properties are seen, and so there is little justification for the further increase in cost for extra materials. In the case of the preferred photographic imaging member, the polyester base containing the clay diffuser layer should have a thickness from 6 to 50 micrometers. Below 6 micrometers, the diffusing properties of the layer are minimized and above 50 the layer becomes more opaque and hinders the quality for illuminated applications with image receiving layers coated on each side.

The inorganic particle and the block copolymer of the invention can be interacted for intercalation and/or exfoliation by any suitable means known in the art of making nanocomposites. For example, clay can be dispersed in suitable monomers or oligomers, which are subsequently polymerized. Alternatively, the inorganic particle can be melt blended with the block copolymer, oligomer or mixtures thereof at temperatures preferably comparable to their melting point or above, and sheared. In another embodiment, the inorganic particle and the block copolymer can be combined in a solvent phase to achieve intercalation and/or exfoliation, followed by solvent removal through drying. Of the aforesaid methods, the one involving melt blending is preferred, for ease of processing.

In a preferred embodiment of the invention the inorganic particle, together with any optional addenda, is melt blended with a block copolymer in a suitable twin screw compounder, to ensure proper mixing. An example of a twin screw compounder used for the experiments detailed below is a Leistritz Micro 27. Twin screw extruders are built on a building block principle. Thus, mixing of additives, residence time of resin, as well as point of addition of additives can be easily changed by changing screw design, barrel design and processing parameters. The Leistritz machine is such a versatile machine. Similar machines are also provided by other twin screw compounder manufacturers like Werner and Pfleiderrer, Berstorff which can be operated either in the co-rotating or the counter-rotating mode. The Leistritz Micro 27 compounder may be operated in the co-rotating or the counter rotating mode.

The screws of the Leistritz compounder are 27 mm in diameter, and they have a functionary length of 40 diameters. The maximum number of barrel zones for this compounder is 10. The maximum screw rotation speed for this compounder is 500 rpm. This twin screw compounder is provided with main feeders through which resins are fed, while additives might be fed using one of the main feeders or using the two side stuffers. If the side stuffers are used to feed the additives then screw design needs to be appropriately configured. The preferred mode of addition of inorganic particle to the block copolymer is through the use of the side stuffer, to ensure splaying of the inorganic particle through proper viscous mixing and to ensure dispersion of the filler through the polymer matrix as well as to control the thermal history of the additives. In this mode, the block copolymer is fed using the main resin feeder, and is followed by the addition of inorganic particle through the downstream side stuffer. Alternatively, the inorganic particle and block copolymer can be fed using the main feeders at the same location.

In yet another embodiment of the invention, the inorganic particle, the splayant and the matrix polymer together with any optional addenda may be melt blended in a suitable twin screw compounder. One of the preferred modes of addition of inorganic particle and the splayant, such as a block copolymer, to the matrix polymer is by the use of side stuffers to ensure splaying, i.e. intercalation and/or exfoliation, of the inorganic particle through proper viscous mixing; the block copolymer first followed by the addition of inorganic particle through the downstream side stuffer or vice versa. The mode of addition will be determined by characteristics of the block copolymer. Alternatively, the inorganic particle and block copolymer are premixed and fed through a single side stuffer. This method is particularly suitable if there is only one side stuffer port available, and also there are limitations on the screw design. Also preferred are methods where the inorganic particle and block copolymer are fed using the main feeders at the same location as the matrix resin.

The clay, together with any optional addenda, may also be melt blended with the splayant, such as a block copolymer, using any suitable mixing device such as a single screw compounder, blender, mixer, spatula, press, extruder, or molder.

The optional addenda mentioned herein above can include nucleating agents, fillers, plasticizers, impact modifiers, chain extenders, colorants, lubricants, antistatic agents, pigments such as titanium oxide, zinc oxide, talc, calcium carbonate, dispersants such as fatty amides, (e.g., stearamide), metallic salts of fatty acids, e.g., zinc stearate, magnesium stearate, dyes such as ultramarine blue, cobalt violet, antioxidants, fluorescent whiteners, ultraviolet absorbers, fire retardants, roughening agents, cross linking agents, voiding agents. These optional addenda and their corresponding amounts can be chosen according to need.

Any method known in the art including those mentioned herein above can be utilized to form an article of the invention comprising a matrix polymer and the splayed inorganic particle of the invention and other optional addenda. Such methods of formation include but are not limited to extrusion, co-extrusion with or without orientation by uniaxial or biaxial, simultaneous or consecutive stretching, blow molding, injection molding, lamination, solvent casting, coating, drawing, or spinning.

The material of the invention comprising the preferred polyester and the splayed inorganic particle can be incorporated in any of these materials and/or their combination for use in the base of the appropriate imaging member. In one embodimant, the base or support may comprise a single layer. In another embodiment, the support may comprise a multilayered imaging member and the aforementioned material of the invention can be any one or more layers, and can be placed anywhere in the imaging support, e.g., on the topside, or the bottom side, or both sides, and/or in between the two sides of the support. Incorporation may include extrusion, co-extrusion with or without stretching, blow molding, casting, co-casting, lamination, calendering, embossing, coating, spraying, molding. The image receiving layer, as per the invention, can be placed on either side or both sides of the imaging support.

In a preferred embodiment of the invention, the layer comprising inorganic particles and polymeric resin matrix comprises an extrusion coated layer. Extrusion coating is preferred as it is low in cost and has been shown to provide excellent adhesion to imaging layers such as silver halide or ink jet receiving layers. An extruded coated layer containing inorganic particles and polymeric resin matrix has also been shown to provide some orientation of the inorganic particles in the polymeric resin matrix providing an improvement in light diffusion compared to the random orientation of coated inorganic particles in a binder.

In another embodiment, the imaging support of the invention comprising polyester as a matrix polymer and the splayed inorganic particle of the invention may be formed by extrusion and/or co-extrusion. This may be followed by orientation, as in typical polyester based photographic film base formation. Alternatively, a composition comprising a matrix polymer and the splayed inorganic particle can be extrusion coated onto another support, as in typical resin coating operation for photographic paper. Yet in another embodiment, a composition comprising polyester as a matrix polymer and the splayed inorganic particle of the invention can be extruded or co-extruded, preferably oriented, into a preformed sheet and subsequently laminated to another support, as in the formation of typical laminated reflective print media.

The imaging supports of the invention can comprise any number of auxiliary layers. Such auxiliary layers may include antistatic layers, back mark retention layers, tie layers or adhesion promoting layers, abrasion resistant layers, conveyance layers, barrier layers, splice providing layers, UV absorption layers, antihalation layers, optical effect providing layers, waterproofing layers. In a preferred embodiment, the support comprises at least one skin layer between the imaging layer and the support. In another embodiment, the imaging member comprises an adhesion layer between said imaging layer and said support.

Duplitized display materials possessing both reflection properties as well as sufficient dye formed on the back side as a means to present pleasing densities when backlit would be highly desired for display applications. The media would present eye-catching and aesthetically pleasing reflection images, as well as being able to provide pleasing images of sufficient dye densities during nighttime or in low ambient light levels when illuminated from the backside. In addition, the dual property of the formed image (both reflection and transmissive) would allow for pleasing images in outdoor applications or those cases subject to non-controllable high ambient reflection surface lighting (man-made or natural) by the property of the formed front side image. By this invention, the face side image formed and backed by the semi-reflective property of the substrate and illuminated by front surface lighting would not appear "blocked in" as conventional transmission only display media would. However, the same attributes that provide a multi purpose media for viewing have been found to present some difficulties in forming said images. The inability to predict the future with regard to printer design and expected wear of existing printers can cause serious deficiencies in correct latent image formation. Specifically, a backside light sensitive layer, when exposed against a backing platen of non-uniform reflectivity (due to either wear or design), can adversely affect both the quality of the formed backside latent image, as well as the subsequently processed image resulting in localized non-uniform dye density. In another embodiment of the invention, an antihalation layer below and adjacent to the bottommost light sensitive layer in the backside structure would clearly resolve the problem of non-uniform reflectivity of any backing apparatus in the printer, but presents its own set of issues. This inclusion of an antihalation layer will solve the problem of backlight scatter by non-uniform reflectivity of media backing in the printer but will also remove the benefit of any secondary exposure of the backside light sensitive layers.

For this invention, both a "primary first exposure" and an automatic "secondary exposure" of the backside emulsion occurs when exposed from only the front side. This is caused by the designed backscatter of the media and compensates for the initial loss of the imaging radiation caused by imaging through the front side of the media and passing through both front side absorber dyes, as well as the turbid support prior to reaching the backside light sensitive layers. In this fashion, a mirror image of the front side image of sufficient sharpness and sufficient dye density is formed on the backside. This allows for both proper image registration (low to no flare of the backside image), as well as sufficient dye density to survive backlighting. In the presence of an antihalation layer on the backside necessitated by uncontrolled backscatter in the printer, the practical result will be a very low density formation of the backside image, and any attempt to increase the front side exposure to improve the backside density will result in overexposure of the face side light sensitive layers, thus degrading the front side image. This obstacle was solved by the invention whereby a tone enhancing layer was added to the backside adjacent to the bottommost light sensitive layer to provide a tunable "secondary exposure" capability, while also allowing for the application of an antihalation layer to defeat any non-uniform reflectivity resulting from any backing platen or stray backlight in the printer. It has been found that these problems can be solved by the addition of a tone enhancing layer between the bottommost light sensitive layer and an antihalation layer. This tone enhancing layer is comprised of gelatin and a component capable of reflecting light with minimal scatter. Suitable materials include, but are not limited to, titanium dioxide, barium sulfate, clay, calcium carbonate, or suitable polymeric materials. Suitable polymeric materials include hollow polystyrene beads such as Ropaque™ beads (HP-1055, Rohm & Haus). Most preferred is $TiO_2$, which may be either of the anatase or rutile type. $TiO_2$ is preferred, as it is low cost, effective, and not reactive with imaging materials.

The tone enhancing layer may be provided with any suitable amount of $TiO_2$ or other light reflecting material. A generally suitable amount is 0.25 to 10 g/m$^2$. A more suitable amount is from 0.75 to 5 g/m$^2$. A preferred amount for best tone enhancing and reasonable cost is from 1.0 to 2.5 g/m$^2$.

The use of this tone enhancing layer also allows for even further improvement of the backside image sharpness, as well as an overall and pleasing increase in transmission maximum density while not adversely affecting the quality the face side image.

In an alternate embodiment, it has been found that a tone enhancing layer beneath the bottommost light sensitive layer can be used without an antihalation layer to enable substantial silver savings, thus resulting in a lower cost product. In this manner, the tone enhancing layer reduces the amount of light lost through the pack and, therefore, the impact of any non-uniform back reflection from printer platens is reduced.

The weight ratio of the inorganic particle: splayant can vary from 1:99 to 99:1. However it is preferred to be from 90:10 to 50:50 and more preferred to be from 80:20 to 60:40, in order to optimize the desirable physical properties of nanocomposite comprised of the inorganic particle and the splayant.

The weight % of inorganic particle in the article comprising the inorganic particle, the splayant and the matrix polymer together with any optional addenda can be as high as 70%. However it is preferred to be less than 50%, and more preferred to be less than 20%, to ensure processability.

As used herein the phrase "imaging element" is a material that may be used as a imaging support for the transfer of images to the support by techniques such as ink jet printing or thermal dye transfer as well as a support for silver halide images. As used herein, the phrase "photographic element" is a material that utilizes photosensitive silver halide in the formation of images. The thermal dye image-receiving layer of receiving elements used with the invention may comprise, for example, a polycarbonate, a polyurethane, a polyester, polyvinyl chloride, poly(styrene-co-acrylonitrile), poly (caprolactone) or mixtures thereof. The dye image-receiving layer may be present in any amount which is effective for the intended purpose. In general, good results have been obtained at a concentration of from 1 to 10 g/m$^2$. An overcoat layer may be further coated over the dye-receiving layer, such as described in U.S. Pat. No. 4,775,657 of Harrison et al.

Dye-donor elements that are used with dye-receiving elements used in the invention conventionally comprise a support having thereon a dye containing layer. Any dye can be used in the dye-donor employed in the invention provided it is transferable to the dye-receiving layer by the action of heat. Especially good results have been obtained with sublimable dyes. Dye donors applicable for use in the present invention are described, e.g., in U.S. Pat. Nos. 4,916,112; 4,927,803 and 5,023,228.

As noted above, dye-donor elements are used to form a dye transfer image. Such a process comprises image-wise-heating a dye-donor element and transferring a dye image to a dye-receiving element as described above to form the dye transfer image.

In a preferred embodiment of the thermal dye transfer method of printing, a dye donor element is employed which compromises a poly-(ethylene terephthalate) support coated with sequential repeating areas of cyan, magenta, and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to receiving elements used with the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer may be used, such as lasers as described in, for example, GB No. 2,083,726A.

A thermal dye transfer assemblage comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The electrographic and electrophotographic processes and their individual steps have been well described in detail in many books and publications. The processes incorporate the basic steps of creating an electrostatic image, developing that image with charged, colored particles (toner), optionally transferring the resulting developed image to a secondary substrate, and fixing the image to the substrate. There are numerous variations in these processes and basic steps; the use of liquid toners in place of dry toners is simply one of those variations.

The first basic step, creation of an electrostatic image, can be accomplished by a variety of methods. The electrophotographic process of copiers uses imagewise photodischarge, through analog or digital exposure, of a uniformly charged photoconductor. The photoconductor may be a single-use system, or it may be rechargeable and reimageable, like those based on selenium or organic photoreceptors.

In an alternate electrographic process, electrostatic images are created iono-graphically. The latent image is created on dielectric (charge-holding) medium, either paper or film. Voltage is applied to selected metal styli or writing nibs from an array of styli spaced across the width of the medium, causing a dielectric breakdown of the air between the selected styli and the medium. Ions are created, which form the latent image on the medium.

Electrostatic images, however generated, are developed with oppositely charged toner particles. For development with liquid toners, the liquid developer is brought into direct contact with the electrostatic image. Usually a flowing liquid is employed, to ensure that sufficient toner particles are available for development. The field created by the electrostatic image causes the charged particles, suspended in a nonconductive liquid, to move by electrophoresis. The charge of the latent electrostatic image is thus neutralized by the oppositely charged particles. The theory and physics of electrophoretic development with liquid toners are well described in many books and publications.

If a reimageable photoreceptor or an electrographic master is used, the toned image is transferred to paper (or other substrate). The paper is charged electrostatically, with the polarity chosen to cause the toner particles to transfer to the paper. Finally, the toned image is fixed to the paper. For self-fixing toners, residual liquid is removed from the paper by air-drying or heating. Upon evaporation of the solvent these toners form a film bonded to the paper. For heat-fusible toners, thermoplastic polymers are used as part of the particle. Heating both removes residual liquid and fixes the toner to paper.

The dye receiving layer or DRL (dye receiving layer) for ink jet imaging may be applied by any known methods. Such as solvent coating, or melt extrusion coating techniques. The DRL is coated over the TL (tie layer) at a thickness ranging from 0.1–10 $\mu$m, preferably 0.5–5 $\mu$m. There are many known formulations which may be useful as dye receiving layers. The primary requirement is that the DRL is compatible with the inks which it will be imaged so as to yield the desirable color gamut and density. As the ink drops pass through the DRL, the dyes are retained or mordanted in the DRL, while the ink solvents pass freely through the DRL and are rapidly absorbed by the TL. Additionally, the DRL formulation is preferably coated from water, exhibits adequate adhesion to the TL, and allows for easy control of the surface gloss.

For example, Misuda et al. in U.S. Pat. Nos. 4,879,166; 5,264,275; 5,104,730; 4,879,166, and Japanese patents 1,095,091; 2,276,671; 2,276,670; 4,267,180; 5,024,335; and 5,016,517 discloses aqueous based DRL formulations comprising mixtures of psuedo-bohemite and certain water soluble resins. Light, in U.S. Pat. Nos. 4,903,040; 4,930,041; 5,084,338; 5,126,194; 5,126,195; and 5,147,717 discloses aqueous-based DRL formulations comprising mixtures of vinyl pyrrolidone polymers and certain water-dispersible and/or water-soluble polyesters, along with other polymers and addenda. Butters et al. in U.S. Pat. Nos. 4,857,386 and 5,102,717 disclose ink-absorbent resin layers comprising mixtures of vinyl pyrrolidone polymers and acrylic or methacrylic polymers. Sato et al. in U.S. Pat. No. 5,194,317 and Higuma et al. in U.S. Pat. No. 5,059,983 disclose aqueous-coatable DRL formulations based on poly(vinyl alcohol). Iqbal, in U.S. Pat. No. 5,208,092, discloses water-based DRL formulations comprising vinyl copolymers which are subsequently cross-linked. In addition to these examples, there may be other known or contemplated DRL formulations which are consistent with the aforementioned primary and secondary requirements of the DRL, all of which fall under the spirit and scope of the current invention.

The preferred DRL is a 0.1–10 micrometers DRL which is coated as an aqueous dispersion of 5 parts alumoxane and 5 parts poly(vinyl pyrrolidone). The DRL may also contain varying levels and sizes of matting agents for the purpose of controlling gloss, friction, and/or finger print resistance, surfactants to enhance surface uniformity and to adjust the surface tension of the dried coating, mordanting agents, anti-oxidants, UV absorbing compounds, light stabilizers.

Although the ink-receiving elements as described above can be successfully used to achieve the advantageives of the present invention, it may be desirable to overcoat the DRL for the purpose of enhancing the durability of the imaged element. Such overcoats may be applied to the DRL either before or after the element is imaged. For example, the DRL can be overcoated with an ink-permeable layer through which inks freely pass. Layers of this type are described in U.S. Pat. Nos. 4,686,118; 5,027,131; and 5,102,717. Alternatively, an overcoat may be added after the element is imaged. Any of the known laminating films and equipment may be used for this purpose. The inks used in the aforementioned imaging process are well known, and the ink formulations are often closely tied to the specific processes, i.e., continuous, piezoelectric, or thermal. Therefore, depending on the specific ink process, the inks may contain widely differing amounts and combinations of solvents, colorants, preservatives, surfactants, humectants. Inks preferred for use in combination with the image recording elements are water-based, such as those currently sold for use in the Hewlett-Packard Desk Writer 560C printer. However, it is intended that alternative embodiments of the image-recording elements as described above, which may be formulated for use with inks which are specific to a given ink-recording process or to a given commercial vendor, fall within the scope of the present invention.

As used herein, the phrase "photographic element" is a material that utilizes photosensitive silver halide in the formation of images. The photographic elements can be black and white, single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

For the display material of this invention, at least one image layer containing silver halide and a dye forming coupler located on the top side or surface and bottom side or surface of the imaging element is suitable. Applying the imaging layer to either the top and bottom is suitable for a photographic display material, but it is not sufficient to create a photographic display material that is optimum for both a reflection display and a transmission display. For the display material of this invention, at least one image layer comprises at least one dye forming coupler located on both the top and bottom of the imaging support of this invention is preferred. Applying an imaging layer to both the top and bottom of the support allows for the display material to have the required density for both reflective viewing and for transmission viewing of the image. This duplitized "day/night" photographic display material has significant commercial value in that the day/night display material can be used for both reflective viewing and transmission viewing. Prior art display materials were optimized for either transmission viewing or reflective viewing but not both simultaneously.

It has been found that the duplitized emulsion coverage should be in a range that is greater than 75% and less than 175% of typical emulsion coverages for reflective consumer paper that contain typical amounts of silver and coupler. At coverages of less than 75% on the front side it was found that a pleasing reflection print could not be obtained. Further, at coverages of less than 75% on the backside, pleasing transmission images could not be obtained. Coverages greater than 175% are undesirable because of the increased material expense and also because of the need for extended development times in the processing solutions. In a more preferred embodiment, emulsion laydowns should be from 100 to 150% of that found for a typical reflective consumer color paper.

The display material of this invention wherein the amount of dye forming coupler is substantially the same on the top and bottom sides is most preferred because it allows for optimization of image density, while allowing for developer time less than 50 seconds. Further, coating substantially the same amount of light sensitive silver halide emulsion on both sides has the additional benefit of balancing the imaging element for image curl caused by the contraction and expansion of the hygroscopic gel typically found in photographic emulsions.

The photographic emulsions useful with this invention are generally prepared by precipitating silver halide crystals in a colloidal matrix by methods conventional in the art. The colloid is typically a hydrophilic sheet forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Chemical sensitization of the emulsion typically employs sensitizers such as: sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

The silver halide emulsions utilized used with this invention may be comprised of any halide distribution. Thus, they may be comprised of silver chloride, silver bromide, silver bromochloride, silver chlorobromide, silver iodochloride, silver iodobromide, silver bromoiodochloride, silver chloroiodobromide, silver iodobromochloride, and silver iodochlorobromide emulsions. It is preferred, however, that the emulsions be predominantly silver chloride emulsions. By predominantly silver chloride, it is meant that the grains of the emulsion are greater than 50 mole percent silver chloride. Preferably, they are greater than 90 mole percent silver chloride; and optimally greater than 95 mole percent silver chloride.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains. Grains having a tabular or cubic morphology are preferred.

The photographic elements of the invention may utilize emulsions as described in *The Theory of the Photographic Process*, Fourth Edition, T. H. James, Macmillan Publishing Company, Inc., 1977, pages 151–152. Reduction sensitization has been known to improve the photographic sensitivity of silver halide emulsions. While reduction sensitized silver halide emulsions generally exhibit good photographic speed, they often suffer from undesirable fog and poor storage stability.

Reduction sensitization can be performed intentionally by adding reduction sensitizers, chemicals that reduce silver ions to form metallic silver atoms, or by providing a reducing environment such as high pH (excess hydroxide ion) and/or low pAg (excess silver ion). During precipitation of a silver halide emulsion, unintentional reduction sensitization can occur when, for example, silver nitrate or alkali solutions are added rapidly or with poor mixing to form emulsion grains. Also, precipitation of silver halide emulsions in the presence of ripeners (grain growth modifiers) such as thioethers, selenoethers, thioureas, or ammonia tends to facilitate reduction sensitization.

Examples of reduction sensitizers and environments which may be used during precipitation or spectral/chemical sensitization to reduction sensitize an emulsion include ascorbic acid derivatives; tin compounds; polyamine compounds; and thiourea dioxide-based compounds described in U.S. Pat. Nos. 2,487,850; 2,512,925; and British Patent 789,823. Specific examples of reduction sensitizers or conditions, such as dimethylamineborane, stannous chloride, hydrazine, high pH (pH 8–11) and low pAg (pAg 1–7) ripening are discussed by S. Collier in Photographic Science and Engineering, 23, p. 113 (1979). Examples of processes for preparing intentionally reduction sensitized silver halide emulsions are described in EP 0 348 934 A1 (Yamashita), EP 0 369 491 (Yamashita), EP 0 371 388 (Ohashi), EP 0 396 424 A1 (Takada), EP 0 404 142 A1 (Yamada), and EP 0 435 355 A1 (Makino).

The photographic elements of this invention may use emulsions doped with Group VIII metals such as iridium, rhodium, osmium, and iron as described in *Research Disclosure*, September 1994, Item 36544, Section I, published by Kenneth Mason Publications, Ltd., Dudley Annex, 12a North Street, Emsworth, Hampshire PO10 7DQ, ENGLAND. Additionally, a general summary of the use of iridium in the sensitization of silver halide emulsions is contained in Carroll, "Iridium Sensitization: A Literature Review," Photographic Science and Engineering, Vol. 24, No. 6, 1980. A method of manufacturing a silver halide emulsion by chemically sensitizing the emulsion in the presence of an iridium salt and a photographic spectral sensitizing dye is described in U.S. Pat. No. 4,693,965. In some cases, when such dopants are incorporated, emulsions show an increased fresh fog and a lower contrast sensitometric curve when processed in the color reversal E-6 process as described in The British Journal of Photography Annual, 1982, pp. 201–203.

A typical multicolor photographic element of the invention comprises the invention laminated support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers. The support of the invention may also be utilized for black and white photographic print elements.

When the base material of the invention with the integral diffusion layer is coated with silver halide photographic element, it is capable of excellent performance when exposed by either an electronic printing method or a conventional optical printing method. An electronic printing method comprises subjecting a radiation sensitive silver halide emulsion layer of a recording element to actinic radiation of at least $10^{-4}$ ergs/cm$^2$ for up to 100 $\mu$seconds duration in a pixel-by-pixel mode wherein the silver halide emulsion layer is comprised of silver halide grains as described above. A conventional optical printing method comprises subjecting a radiation sensitive silver halide emulsion layer of a recording element to actinic radiation of at least $10^{-4}$ ergs/cm$^2$ for $10^{-3}$ to 300 seconds in an imagewise mode wherein the silver halide emulsion layer is comprised of silver halide grains as described above. A radiation-sensitive emulsion comprised of silver halide grains (a) containing greater than 50 mole percent chloride, based on silver, (b) having greater than 50 percent of their surface area provided by {100} crystal faces, and (c) having a central portion accounting for from 95 to 99 percent of total silver and containing two dopants selected to satisfy each of the following class requirements: (i) a hexacoordination metal complex which satisfies the formula $$[ML_6]^n \quad \text{(I)}$$

wherein n is zero, −1, −2, −3, or −4; M is a filled frontier orbital polyvalent metal ion, other than iridium; and $L_6$ represents bridging ligands which can be independently selected, provided that least four of the ligands are anionic ligands, and at least one of the ligands is a cyano ligand or a ligand more electronegative than a cyano ligand; and (ii) an iridium coordination complex containing a thiazole or substituted thiazole ligand may be used with the present invention.

The combination of dopants (i) and (ii) provides greater reduction in reciprocity law failure than can be achieved with either dopant alone. The combination of dopants (i) and (ii) achieves reductions in reciprocity law failure beyond the simple additive sum achieved when employing either dopant class by itself. The combination of dopants (i) and (ii) provides greater reduction in reciprocity law failure, particularly for high intensity and short duration exposures. The combination of dopants (i) and (ii) further achieves high intensity reciprocity with iridium at relatively low levels, and both high and low intensity reciprocity improvements even while using conventional gelatino-peptizer (e.g., other than low methionine gelatino-peptizer).

In a preferred practical application, the advantages of the invention can be transformed into increased throughput of digital substantially artifact-free color print images while exposing each pixel sequentially in synchronism with the digital data from an image processor.

Improved reciprocity performance can be obtained for silver halide grains (a) containing greater than 50 mole percent chloride, based on silver, and (b) having greater than 50 percent of their surface area provided by {100} crystal faces by employing a hexacoordination complex dopant of class (i) in combination with an iridium complex dopant comprising a thiazole or substituted thiazole ligand. The reciprocity improvement is obtained for silver halide grains employing conventional gelatino-peptizer, unlike the contrast improvement described for the combination of dopants set forth in U.S. Pat. Nos. 5,783,373 and 5,783,378, which requires the use of low methionine gelatino-peptizers as discussed therein, and which states it is preferable to limit the concentration of any gelatino-peptizer with a methionine level of greater than 30 micromoles per gram to a concentration of less than 1 percent of the total peptizer employed. It is specifically contemplated to use significant levels (i.e., greater than 1 weight percent of total peptizer) of conventional gelatin (e.g., gelatin having at least 30 micromoles of methionine per gram) as a gelatino-peptizer for the silver halide grains of the emulsions of the invention. A gelatino-peptizer is employed which comprises at least 50 weight percent of gelatin containing at least 30 micromoles of methionine per gram, as it is frequently desirable to limit the level of oxidized low methionine gelatin which may be used for cost and certain performance reasons.

It may be contemplated to employ a class (i) hexacoordination complex dopant satisfying the formula:

$$[ML_6]^n \quad (I)$$

wherein n is zero, −1, −2, −3, or −4;

M is a filled frontier orbital polyvalent metal ion, other than iridium, preferably $Fe^{+2}$, $Ru^{+2}$, $Os^{+2}$, $Co^{+3}$, $Rh^{+3}$, $Pd^{+4}$ or $Pt^{+4}$, more preferably an iron, ruthenium or osmium ion, and most preferably a ruthenium ion;

$L_6$ represents six bridging ligands which can be independently selected, provided that least four of the ligands are anionic ligands and at least one (preferably at least 3 and optimally at least 4) of the ligands is a cyano ligand or a ligand more electronegative than a cyano ligand. Any remaining ligands can be selected from among various other bridging ligands, including aquo ligands, halide ligands (specifically, fluoride, chloride, bromide and iodide), cyanate ligands, thiocyanate ligands, selenocyanate ligands, tellurocyanate ligands, and azide ligands. Hexacoordinated transition metal complexes of class (i) which include six cyano ligands are specifically preferred.

Illustrations of specifically contemplated class (i) hexacoordination complexes for inclusion in the high chloride grains are provided by Olm et al U.S. Pat. No. 5,503,970 and Daubendiek et al U.S. Pat. Nos. 5,494,789 and 5,503,971, and Keevert et al U.S. Pat. No. 4,945,035, as well as Murakami et al Japanese Patent Application Hei-2[1990]-249588, and *Research Disclosure* Item 36736. Useful neutral and anionic organic ligands for class (ii) dopant hexacoordination complexes are disclosed by Olm et al U.S. Pat. No. 5,360,712 and Kuromoto et al U.S. Pat. No. 5,462,849.

Class (i) dopant is preferably introduced into the high chloride grains after at least 50 (most preferably 75 and optimally 80) percent of the silver has been precipitated, but before precipitation of the central portion of the grains has been completed. Preferably class (i) dopant is introduced before 98 (most preferably 95 and optimally 90) percent of the silver has been precipitated. Stated in terms of the fully precipitated grain structure, class (i) dopant is preferably present in an interior shell region that surrounds at least 50 (most preferably 75 and optimally 80) percent of the silver and, with the more centrally located silver, accounts the entire central portion (99 percent of the silver), most preferably accounts for 95 percent, and optimally accounts for 90 percent of the silver halide forming the high chloride grains. The class (i) dopant can be distributed throughout the interior shell region delimited above or can be added as one or more bands within the interior shell region.

Class (i) dopant can be employed in any conventional useful concentration. A preferred concentration range is from $10^{-8}$ to $10^{-3}$ mole per silver mole, most preferably from $10^{-6}$ to $5\times10^{-4}$ mole per silver mole.

The following are specific illustrations of class (i) dopants:

(i-1) $[Fe(CN)_6]^{-4}$
(i-2) $[Ru(CN)_6]^{-4}$
(i-3) $[Os(CN)_6]^{-4}$
(i-4) $[Rh(CN)_6]^{-3}$
(i-5) $[Co(CN)_6]^{-3}$
(i-6) $[Fe(pyrazine)(CN)_5]^{-4}$
(i-7) $[RuCl(CN)_5]^{-4}$
(i-8) $[OsBr(CN)_5]^{-4}$
(i-9) $[RhF(CN)_5]^{-3}$
(i-10) $[In(NCS)_6]^{-3}$
(i-11) $[FeCO(CN)_5]^{-3}$
(i-12) $[RuF_2(CN)_4]^{-4}$
(i-13) $[OsCl_2(CN)_4]^{-4}$
(i-14) $[RhI_2(CN)_4]^{-3}$
(i-15) $[Ga(NCS)_6]^{-3}$
(i-16) $[Ru(CN)_5(OCN)]^{-4}$
(i-17) $[Ru(CN)_5(N_3)]^{-4}$
(i-18) $[Os(CN)_5(SCN)]^{-4}$
(i-19) $[Rh(CN)_5(SeCN)]^{-3}$
(i-20) $[Os(CN)Cl_5]^{-4}$
(i-21) $[Fe(CN)_3Cl_3]^{-3}$
(i-22) $[Ru(CO)_2(CN)_4]^{-1}$ When the class (i) dopants have a net negative charge, it is appreciated that they are associated with a counter ion when added to the reaction vessel during precipitation. The counter ion is of little importance, since it is ionically dissociated from the dopant in solution and is not incorporated within the grain. Common counter ions known to be fully compatible with silver chloride precipitation, such as ammonium and alkali metal ions, are contemplated. It is noted that the same comments apply to class (ii) dopants, otherwise described below.

The class (ii) dopant is an iridium coordination complex containing at least one thiazole or substituted thiazole ligand. Careful scientific investigations have revealed Group VIII hexahalo coordination complexes to create deep electron traps, as illustrated R. S. Eachus, R. E. Graves and M. T. Olm *J. Chem. Phys.*, Vol. 69, pp. 4580–7 (1978) and *Physica Status Solidi A*, Vol. 57, 429–37 (1980) and R. S. Eachus and M. T. Olm *Annu. Rep. Prog. Chem. Sect. C. Phys. Chem.*, Vol. 83, 3, pp. 3–48 (1986). The class (ii) dopants are believed to create such deep electron traps. The thiazote ligands may be substituted with any photographically acceptable substituent which does not prevent incorporation of the dopant into the silver halide grain. Exemplary substituents include lower alkyl (e.g., alkyl groups containing 1–4 carbon atoms), and specifically methyl. A specific example of a substituted thiazole ligand which may be used is 5-methylthiazole. The class (ii) dopant preferably is an iridium coordination complex having ligands each of which are more electropositive than a cyano ligand. In a specifically preferred form the remaining non-thiazole or non-substituted-thiazole ligands of the coordination complexes forming class (ii) dopants are halide ligands.

It is specifically contemplated to select class (ii) dopants from among the coordination complexes containing organic ligands disclosed by Olm et al U.S. Pat. No. 5,360,712; Olm et al U.S. Pat. No. 5,457,021; and Kuromoto et al U.S. Pat. No. 5,462,849.

In a preferred form it is contemplated to employ as a class (ii) dopant a hexacoordination complex satisfying the formula:

$$[IrL^1{}_6]^{n'} \quad (II)$$

wherein n' is zero, −1, −2, −3, or −4; and $L^1{}_6$ represents six bridging ligands which can be independently selected, provided that at least four of the ligands are anionic ligands, each of the ligands is more electropositive than a cyano ligand, and at least one of the ligands comprises a thiazole or substituted thiazole ligand. In a specifically preferred form at least four of the ligands are halide ligands, such as chloride or bromide ligands.

Class (ii) dopant is preferably introduced into the high chloride grains after at least 50 (most preferably 85 and optimally 90) percent of the silver has been precipitated, but before precipitation of the central portion of the grains has been completed. Preferably class (ii) dopant is introduced before 99 (most preferably 97 and optimally 95) percent of the silver has been precipitated. Stated in terms of the fully precipitated grain structure, class (ii) dopant is preferably present in an interior shell region that surrounds at least 50 (most preferably 85 and optimally 90) percent of the silver and, with the more centrally located silver, accounts the entire central portion (99 percent of the silver), most preferably accounts for 97 percent, and optimally accounts for 95 percent of the silver halide forming the high chloride grains. The class (ii) dopant can be distributed throughout the interior shell region delimited above or can be added as one or more bands within the interior shell region.

Class (ii) dopant can be employed in any conventional useful concentration. A preferred concentration range is from $10^{-9}$ to $10^{-4}$ mole per silver mole. Iridium is most preferably employed in a concentration range of from $10^{-8}$ to $10^{-5}$ mole per silver mole.

Specific illustrations of class (ii) dopants are the following:

(ii-1) $[IrCl_5(thiazole)]^{-2}$
(ii-2) $[IrCl_4(thiazole)_2]^{-1}$
(ii-3) $[IrBr_5(thiazole)]^{-2}$
(ii-4) $[IrBr_4(thiazole)_2]^{-1}$
(ii-5) $[IrCl_5(5\text{-methylthiazole})]^{-2}$
(ii-6) $[IrCl_4(5\text{-methylthiazole})_2]^{-1}$
(ii-7) $[IrBr_5(5\text{-methylthiazole})]^{-2}$
(ii-8) $[IrBr_4(5\text{-methylthiazole})_2]^{-1}$ A layer using a magenta dye forming coupler, a class (ii) dopant in combination with an $OsCl_5(NO)$ dopant has been found to produce a preferred result.

Emulsions can be realized by modifying the precipitation of conventional high chloride silver halide grains having predominantly (>50%) {100} crystal faces by employing a combination of class (i) and (ii) dopants as described above.

The silver halide grains precipitated contain greater than 50 mole percent chloride, based on silver. Preferably the grains contain at least 70 mole percent chloride and, optimally at least 90 mole percent chloride, based on silver. Iodide can be present in the grains up to its solubility limit, which is in silver iodochloride grains, under typical conditions of precipitation, 11 mole percent, based on silver. It is preferred for most photographic applications to limit iodide to less than 5 mole percent iodide, most preferably less than 2 mole percent iodide, based on silver.

Silver bromide and silver chloride are miscible in all proportions. Hence, any portion, up to 50 mole percent, of the total halide not accounted for chloride and iodide, can be bromide. For color reflection print (i.e., color paper) uses bromide is typically limited to less than 10 mole percent based on silver, and iodide is limited to less than 1 mole percent based on silver.

In a widely used form high chloride grains are precipitated to form cubic grains—that is, grains having {100} major faces and edges of equal length. In practice ripening effects usually round the edges and comers of the grains to some extent. However, except under extreme ripening conditions substantially more than 50 percent of total grain surface area is accounted for by {100} crystal faces.

High chloride tetradecahedral grains are a common variant of cubic grains. These grains contain 6 {100} crystal faces and 8 {111} crystal faces. Tetradecahedral grains are within the contemplation of this invention to the extent that greater than 50 percent of total surface area is accounted for by {100} crystal faces.

Although it is common practice to avoid or minimize the incorporation of iodide into high chloride grains employed in color paper, it is has been recently observed that silver iodochloride grains with {100} crystal faces and, in some instances, one or more {111} faces offer exceptional levels of photographic speed. In the these emulsions iodide is incorporated in overall concentrations of from 0.05 to 3.0 mole percent, based on silver, with the grains having a surface shell of greater than 50 Å that is substantially free of iodide and a interior shell having a maximum iodide concentration that surrounds a core accounting for at least 50 percent of total silver. Such grain structures are illustrated by Chen et al EPO 0 718 679.

In another improved form the high chloride grains can take the form of tabular grains having {100} major faces. Preferred high chloride {100} tabular grain emulsions are those in which the tabular grains account for at least 70 (most preferably at least 90) percent of total grain projected area. Preferred high chloride {100} tabular grain emulsions have average aspect ratios of at least 5 (most preferably at least >8). Tabular grains typically have thicknesses of less than 0.3 μm, preferably less than 0.2 μm, and optimally less than 0.07 μm. High chloride {100} tabular grain emulsions and their preparation are disclosed by Maskasky U.S. Pat. Nos. 5,264,337 and 5,292,632; House et al U.S. Pat. No. 5,320,938; Brust et al U.S. Pat. No. 5,314,798; and Chang et al U.S. Pat. No. 5,413,904.

Once high chloride grains having predominantly {100} crystal faces have been precipitated with a combination of class (i) and class (ii) dopants described above, chemical and spectral sensitization, followed by the addition of conventional addenda to adapt the emulsion for the imaging application of choice can take any convenient conventional form. These conventional features are illustrated by *Research Disclosure*, Item 38957, cited above, particularly:

III. Emulsion washing;
IV. Chemical sensitization;
V. Spectral sensitization and desensitization;
VII. Antifoggants and stabilizers;
VIII. Absorbing and scattering materials;
IX. Coating and physical property modifying addenda; and
X. Dye image formers and modifiers.

Some additional silver halide, typically less than 1 percent, based on total silver, can be introduced to facilitate chemical sensitization. It is also recognized that silver halide can be epitaxially deposited at selected sites on a host grain to increase its sensitivity. For example, high chloride {100} tabular grains with corner epitaxy are illustrated by Maskasky U.S. Pat. No. 5,275,930. For the purpose of providing a clear demarcation, the term "silver halide grain" is herein employed to include the silver necessary to form the grain up to the point that the final {100} crystal faces of the grain are formed. Silver halide later deposited that does not overlie the {100} crystal faces previously formed accounting for at least 50 percent of the grain surface area is excluded in determining total silver forming the silver halide grains. Thus, the silver forming selected site epitaxy is not part of the silver halide grains while silver halide that deposits and provides the final {100} crystal faces of the grains is included in the total silver forming the grains, even when it differs significantly in composition from the previously precipitated silver halide.

Image dye-forming couplers may be included in the element such as couplers that form cyan dyes upon reaction with oxidized color developing agents which are described in such representative patents and publications as: U.S. Pat. Nos. 2,367,531; 2,423,730; 2,474,293; 2,772,162; 2,895,826; 3,002,836; 3,034,892; 3,041,236; 4,883,746 and "Farbkuppler—Eine Literature Ubersicht," published in Agfa Mitteilungen, Band III, pp. 156–175 (1961). Preferably such couplers are phenols and naphthols that form cyan dyes on reaction with oxidized color developing agent. Also preferable are the cyan couplers described in, for instance, European Patent Application Nos. 491,197; 544,322; 556,700; 556,777; 565,096; 570,006; and 574,948.

Typical cyan couplers are represented by the following formulas:

CYAN-1

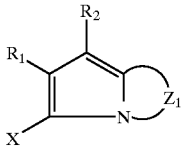

CYAN-2

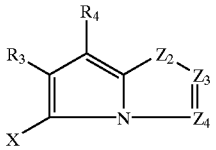

CYAN-3

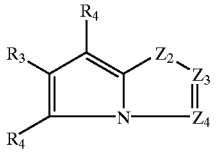

CYAN-4

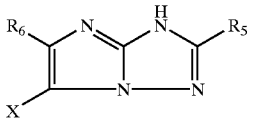

wherein $R_1$, $R_5$ and $R_8$ each represents a hydrogen or a substituent; $R_2$ represents a substituent; $R_3$, $R_4$ and $R_7$ each represents an electron attractive group having a Hammett's substituent constant $\sigma_{para}$ of 0.2 or more and the sum of the $\sigma_{para}$ values of $R_3$ and $R_4$ is 0.65 or more; $R_6$ represents an electron attractive group having a Hammett's substituent constant $\sigma_{para}$ of 0.35 or more; X represents a hydrogen or a coupling-off group; $Z_1$ represents nonmetallic atoms necessary for forming a nitrogen-containing, six-membered, heterocyclic ring which has at least one dissociative group; $Z_2$ represents —C($R_7$)═ and —N═; and $Z_3$ and $Z_4$ each represents —C($R_8$)═ and —N═.

Even more preferable are cyan couplers of the following formulas:

CYAN-5

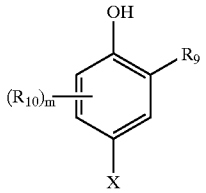

-continued

CYAN-6

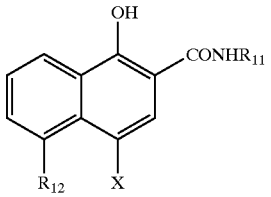

wherein $R_9$ represents a substituent (preferably a carbamoyl, ureido, or carbonamido group); $R_{10}$ represents a substituent (preferably individually selected from halogens, alkyl, and carbonamido groups); $R_{11}$ represents ballast substituent; $R_{12}$ represents a hydrogen or a substituent (preferably a carbonamido or sulphonamido group); X represents a hydrogen or a coupling-off group; and m is from 1–3.

A dissociative group has an acidic proton, e.g., —NH—, —CH(R)—, that preferably has a pKa value of from 3 to 12 in water. Hammett's rule is an empirical rule proposed by L. P. Hammett in 1935 for the purpose of quantitatively discussing the influence of substituents on reactions or equilibria of a benzene derivative having the substituent thereon. This rule has become widely accepted. The values for Hammett's substituent constants can be found or measured as is described in the literature. For example, see C. Hansch and A. J. Leo, *J. Med. Chem.*, 16, 1207 (1973); *J. Med. Chem.*, 20, 304 (1977); and J. A. Dean, *Lange's Handbook of Chemistry*, 12th Ed. (1979) (McGraw-Hill).

Another type of preferred cyan coupler is an "NB coupler" which is a dye-forming coupler which is capable of coupling with the developer 4-amino-3-methyl-N-ethyl-N-(2-methanesulfonamidoethyl) aniline sesquisulfate hydrate to form a dye for which the left bandwidth (LBW) of its absorption spectra upon "spin coating" of a 3% w/v solution of the dye in di-n-butyl sebacate solvent is at least 5 nm. less than the LBW for a 3% w/v solution of the same dye in acetonitrile. The LBW of the spectral curve for a dye is the distance between the left side of the spectral curve and the wavelength of maximum absorption measured at a density of half the maximum.

The "spin coating" sample is prepared by first preparing a solution of the dye in di-n-butyl sebacate solvent (3% w/v). If the dye is insoluble, dissolution is achieved by the addition of some methylene chloride. The solution is filtered and 0.1–0.2 ml is applied to a clear polyethylene terephthalate support (approximately 4 cm×4 cm) and spun at 4,000 RPM using the Spin Coating equipment, Model No. EC101, available from Headway Research Inc., Garland Tex. The transmission spectra of the so prepared dye samples are then recorded.

Preferred "NB couplers" form a dye which, in n-butyl sebacate, has a LBW of the absorption spectra upon "spin coating" which is at least 15 nm, preferably at least 25 nm, less than that of the same dye in a 3% solution (w/v) in acetonitrile.

A cyan dye-forming "NB coupler" which may be useful in the invention has the formula (IA)

(IA)

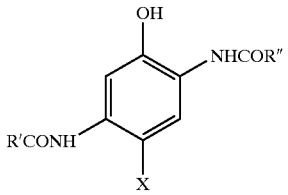

wherein

R' and R" are substituents selected such that the coupler is a "NB coupler", as herein defined; and Z is a hydrogen atom or a group which can be split off by the reaction of the coupler with an oxidized color developing agent.

The coupler of formula (IA) is a 2,5-diamido phenolic cyan coupler wherein the substituents R' and R" are preferably independently selected from unsubstituted or substituted alkyl, aryl, amino, alkoxy and heterocyclyl groups.

The "NB coupler" has the formula (I):

(I)

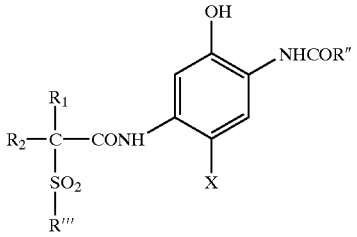

wherein

R" and R'" are independently selected from unsubstituted or substituted alkyl, aryl, amino, alkoxy and heterocyclyl groups and Z is as ereinbefore defined;

$R_1$ and $R_2$ are independently hydrogen or an unsubstituted or substituted alkyl group; and Typically, R" is an alkyl, amino or aryl group, suitably a phenyl group. R'" is desirably an alkyl or aryl group or a 5- to 10-membered heterocyclic ring which contains one or more heteroatoms selected from nitrogen, oxygen and sulfur, which ring group is unsubstituted or substituted.

In the preferred embodiment the coupler of formula (I) may be a 2,5-diamido phenol in which the 5-amido moiety is an amide of a carboxylic acid which is substituted in the alpha position by a particular sulfone ($—SO_2^-$) group such as, for example, described in U.S. Pat. No. 5,686,235. The sulfone moiety is an unsubstituted or substituted alkylsulfone or a heterocyclyl sulfone. or it is an arylsulfone, which is preferably substituted, in particular in the meta and/or para position.

Couplers having these structures of formulae (I) or (IA) comprise cyan dye-forming "NB couplers" which form image dyes having very sharp-cutting dye hues on the short wavelength side of the absorption curves with absorption maxima ($\lambda_{max}$) which are shifted hypsochromically and are generally in the range of 620–645 nm, which is ideally suited for producing excellent color reproduction and high color saturation in color photographic papers.

Referring to formula (I), $R_1$ and $R_2$ are independently hydrogen or an unsubstituted or substituted alkyl group, preferably having from 1 to 24 carbon atoms and, in particular, 1 to 10 carbon atoms, suitably a methyl, ethyl, n-propyl, isopropyl, butyl or decyl group or an alkyl group substituted with one or more fluoro, chloro or bromo atoms, such as a trifluoromethyl group. Suitably, at least one of $R_1$ and $R_2$ is a hydrogen atom, and if only one of $R_1$ and $R_2$ is a hydrogen atom, then the other is preferably an alkyl group having 1 to 4 carbon atoms, more preferably 1 to 3 carbon atoms, and desirably two carbon atoms.

As used herein and throughout the specification unless where specifically stated otherwise, the term "alkyl" refers to an unsaturated or saturated straight or branched chain alkyl group, including alkenyl, and includes aralkyl and cyclic alkyl groups, including cycloalkenyl, having 3–8 carbon atoms and the term 'aryl' includes specifically fused aryl.

In formula (I), R" is suitably an unsubstituted or substituted amino, alkyl or aryl group or a 5- to 10-membered heterocyclic ring which contains one or more heteroatoms selected from nitrogen, oxygen and sulfur, which ring is unsubstituted or substituted, but is more suitably an unsubstituted or substituted phenyl group.

Examples of suitable substituent groups for this aryl or heterocyclic ring include cyano, chloro, fluoro, bromo, iodo, alkyl- or aryl-carbonyl, alkyl- or aryl-oxycarbonyl, carbonamido, alkyl- or aryl-carbonamido, alkyl- or aryl-sulfonyl, alkyl- or aryl-sulfonyloxy, alkyl- or aryl-oxysulfonyl, alkyl- or aryl-sulfoxide, alkyl- or aryl-sulfamoyl, alkyl- or aryl-sulfonamido, aryl, alkyl, alkoxy, aryloxy, nitro, alkyl- or aryl-ureido and alkyl- or aryl-carbamoyl groups, any of which may be further substituted. Preferred groups are halogen, cyano, alkoxycarbonyl, alkylsulfamoyl, alkyl-sulfonamido, alkylsulfonyl, carbamoyl, alkylcarbamoyl or alkylcarbonamido. Suitably, R" is a 4-chlorophenyl, 3,4-dichlorophenyl, 3,4-difluorophenyl, 4-cyanophenyl, 3-chloro-4-cyanophenyl, pentafluorophenyl, or a 3- or 4-sulfonamidophenyl group.

In formula (I) when R'" is alkyl, it may be unsubstituted or substituted with a substituent such as halogen or alkoxy. When R'" is aryl or a heterocycle, it may be substituted. Desirably, it is not substituted in the position alpha to the sulfonyl group.

In formula (I), when R'" is a phenyl group, it may be substituted in the meta and/or para positions with 1 to 3 substituents independently selected from the group consisting of halogen, and unsubstituted or substituted alkyl, alkoxy, aryloxy, acyloxy, acylamino, alkyl- or aryl-sulfonyloxy, alkyl- or aryl-sulfamoyl, alkyl- or aryl-sulfamoylamino, alkyl- or aryl-sulfonamido, alkyl- or aryl-ureido, alkyl- or aryl-oxycarbonyl, alkyl- or aryl-oxycarbonylamino and alkyl- or aryl-carbamoyl groups.

In particular, each substituent may be an alkyl group such as methyl, t-butyl, heptyl, dodecyl, pentadecyl, octadecyl or 1,1,2,2-tetramethylpropyl; an alkoxy group such as methoxy, t-butoxy, octyloxy, dodecyloxy, tetradecyloxy, hexadecyloxy or octadecyloxy; an aryloxy group such as phenoxy, 4-t-butylphenoxy or 4-dodecyl-phenoxy; an alkyl- or aryl-acyloxy group such as acetoxy or dodecanoyloxy; an alkyl- or aryl-acylamino group such as acetamido, hexadecanamido or benzamido; an alkyl- or aryl-sulfonyloxy group such as methyl-sulfonyloxy, dodecylsulfonyloxy or 4-methylphenyl-sulfonyloxy; an alkyl- or aryl-sulfamoyl-group such as N-butylsulfamoyl or N-4-t-butylphenylsulfamoyl; an alkyl- or aryl-sulfamoylamino group such as N-butyl-sulfamoylamino or N-4-t-butylphenylsulfamoyl-amino; an alkyl- or aryl-sulfonamido group such as methane-sulfonamido, hexadecanesulfonamido or 4-chlorophenyl-sulfonamido; an alkyl- or aryl-ureido group such as methylureido or phenylureido; an alkoxy- or aryloxy-carbonyl such as methoxycarbonyl or phenoxycarbonyl; an alkoxy- or aryloxy-carbonylamino group such as methoxycarbonylamino or phenoxycarbonylamino; an alkyl- or aryl-carbamoyl group such as N-butylcarbamoyl or N-methyl-N-dodecylcarbamoyl; or a perfluoroalkyl group such as trifluoromethyl or heptafluoropropyl.

Suitably, the above substituent groups have 1 to 30 carbon atoms, more preferably 8 to 20 aliphatic carbon atoms. A desirable substituent is an alkyl group of 12 to 18 aliphatic carbon atoms such as dodecyl, pentadecyl or octadecyl or an alkoxy group with 8 to 18 aliphatic carbon atoms such as dodecyloxy and hexadecyloxy or a halogen such as a meta or para chloro group, carboxy or sulfonamido. Any such groups may contain interrupting heteroatoms such as oxygen to form e.g. polyalkylene oxides.

In formula (I) or (IA), Z is a hydrogen atom or a group which can be split off by the reaction of the coupler with an oxidized color developing agent, known in the photographic art as a 'coupling-off group' and may preferably be hydrogen, chloro, fluoro, substituted aryloxy or mercaptotetrazole, more preferably hydrogen or chloro.

The presence or absence of such groups determines the chemical equivalency of the coupler, i.e., whether it is a 2-equivalent or 4-equivalent coupler, and its particular identity can modify the reactivity of the coupler. Such groups can advantageously affect the layer in which the coupler is coated, or other layers in the photographic recording material by performing, after release from the coupler, functions such as dye formation, dye hue adjustment, development acceleration or inhibition, bleach acceleration or inhibition, electron transfer facilitation, color correction.

Representative classes of such coupling-off groups include, for example, halogen, alkoxy, aryloxy, heterocyclyloxy, sulfonyloxy, acyloxy, acyl, heterocyclylsulfonamido, heterocyclylthio, benzothiazolyl, phosophonyloxy, alkylthio, arylthio, and arylazo. These coupling-off groups are described in the art, for example, in U.S. Pat. Nos. 2,455,169; 3,227,551; 3,432,521; 3,467,563; 3,617,291; 3,880,661; 4,052,212; and 4,134,766; and in U.K. Patent Nos. and published applications 1,466,728; 1,531,927; 1,533,039; 2,066,755A, and 2,017,704A. Halogen, alkoxy, and aryloxy groups are most suitable.

Examples of specific coupling-off groups are —Cl, —F, —Br, —SCN, $—OCH_3$, $—OC_6H_5$, $—OCH_2C(=O)NHCH_2CH_2OH$, $—OCH_2C(O)NHCH_2CH_2OCH_3$, $—OCH_2C(O)NHCH_2CH_2OC(=O)OCH_3$, $—P(=O)(OC_2H_5)_2$, $—SCH_2CH_2COOH$,

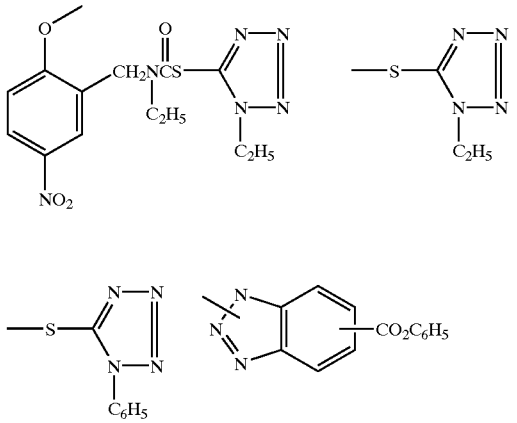

-continued

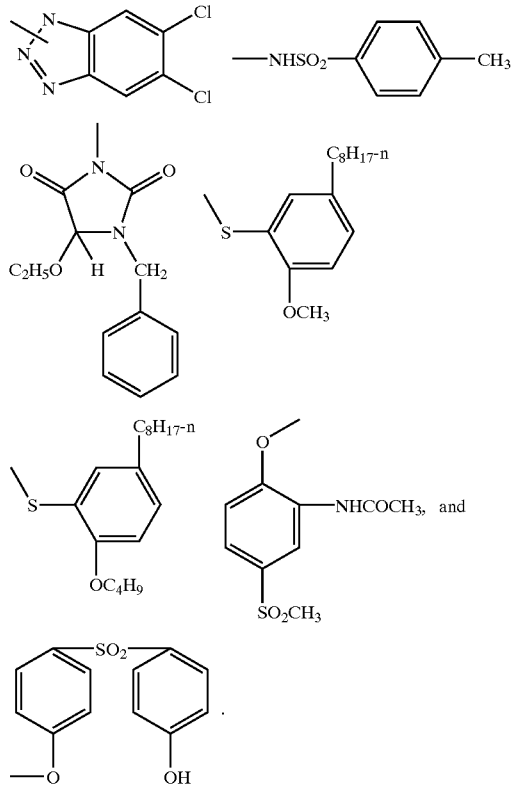

Typically, the coupling-off group is a chlorine atom, hydrogen atom, or p-methoxyphenoxy group.

It is essential that the substituent groups be selected so as to adequately ballast the coupler and the resulting dye in the organic solvent in which the coupler is dispersed. The ballasting may be accomplished by providing hydrophobic substituent groups in one or more of the substituent groups. Generally a ballast group is an organic radical of such size and configuration as to confer on the coupler molecule sufficient bulk and aqueous insolubility as to render the coupler substantially nondiffusible from the layer in which it is coated in a photographic element. Thus, the combination of substituent are suitably chosen to meet these criteria. To be effective, the ballast will usually contain at least 8 carbon atoms and typically contains 10 to 30 carbon atoms. Suitable ballasting may also be accomplished by providing a plurality of groups which, in combination, meet these criteria. In the preferred embodiments of the invention, $R_1$ in formula (I) is a small alkyl group or hydrogen. Therefore, in these embodiments the ballast would be primarily located as part of the other groups. Furthermore, even if the coupling-off group Z contains a ballast, it is often necessary to ballast the other substituents as well, since Z is eliminated from the molecule upon coupling; thus, the ballast is most advantageously provided as part of groups other than Z.

The following examples further illustrate preferred cyan couplers to be used with the invention. It is not to be construed that the present invention is limited to these examples.

IC-1
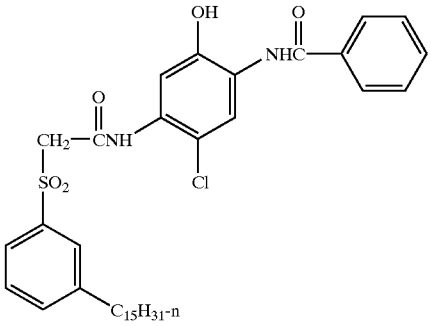
IC-2
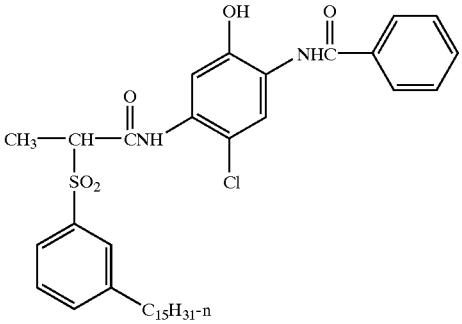
IC-3
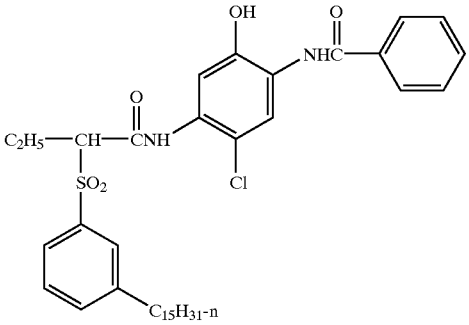
IC-4
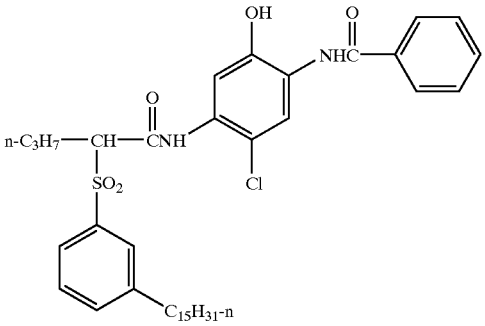
-continued
IC-5
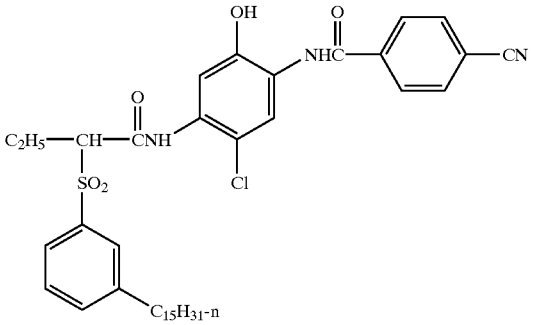
IC-6
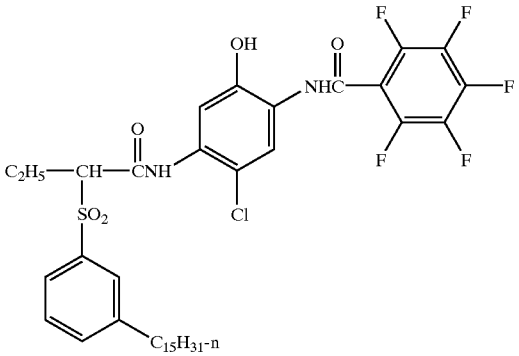
IC-7
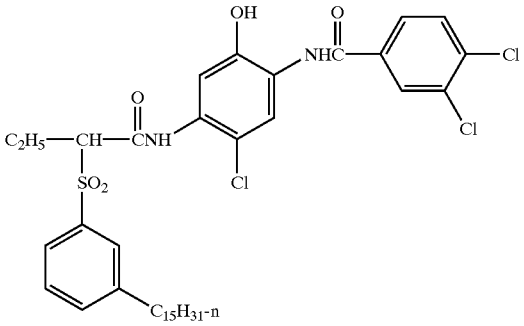
IC-8
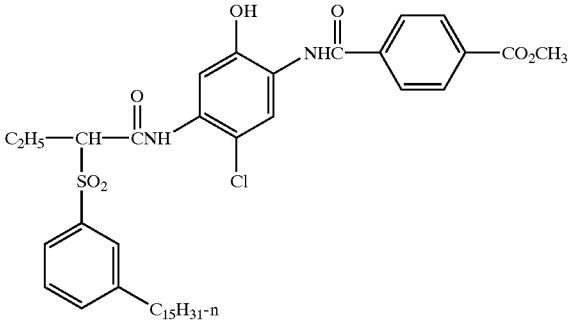

-continued
IC-9
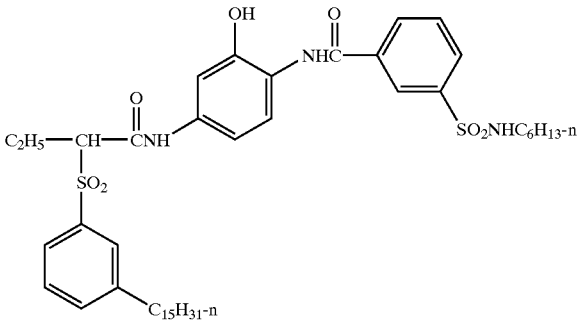
IC-10
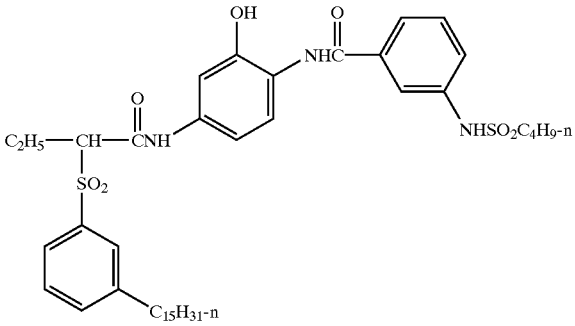
IC-11
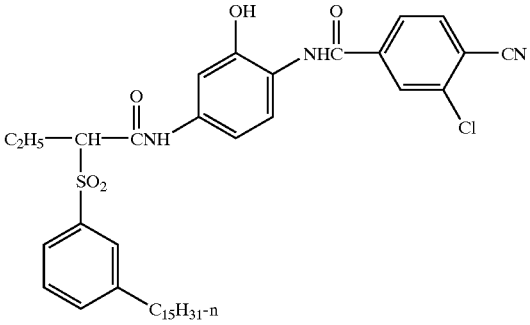
IC-12
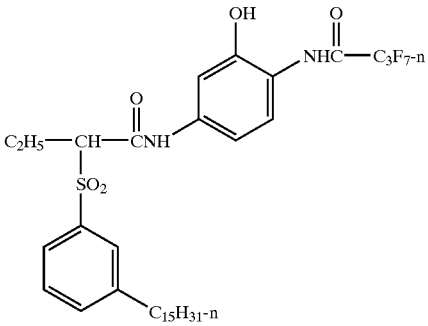
-continued
IC-13
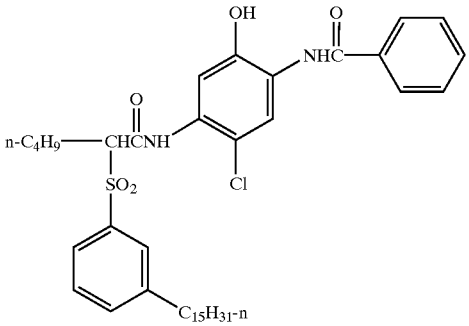
IC-14
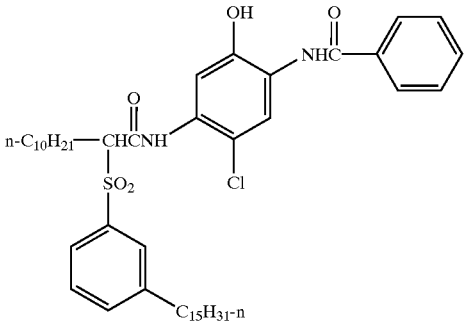
IC-15
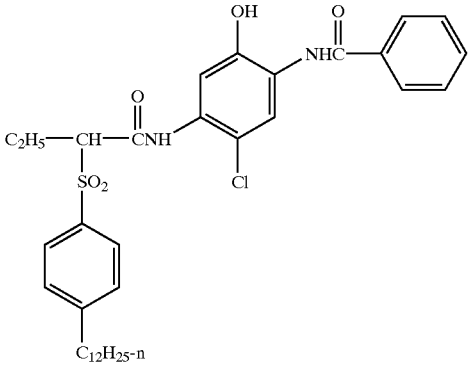
IC-16
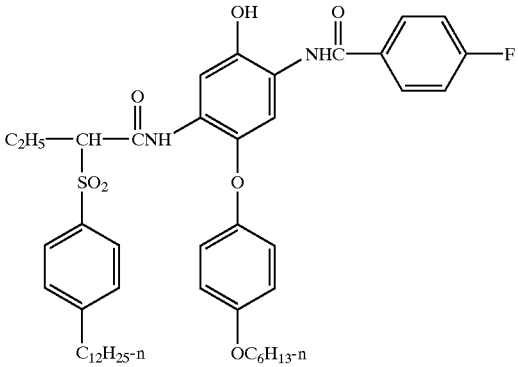

-continued
IC-17
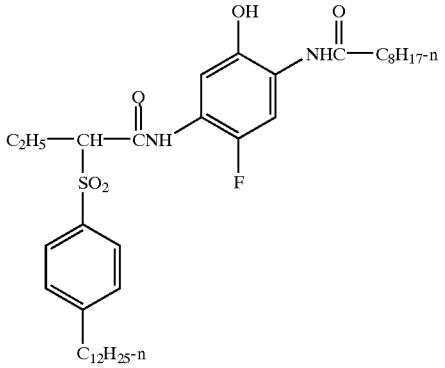
IC-18
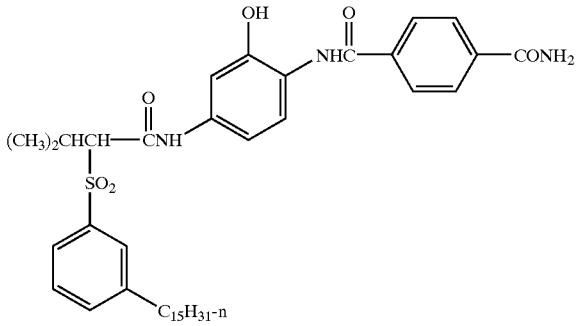
IC-19
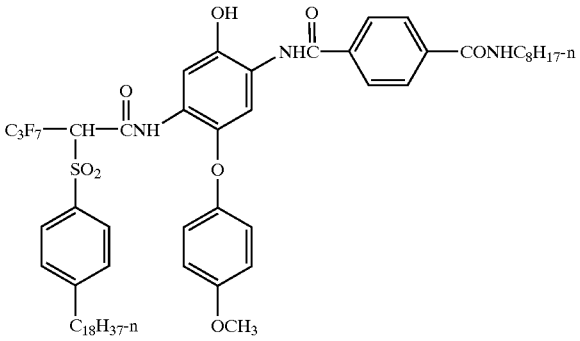
IC-20
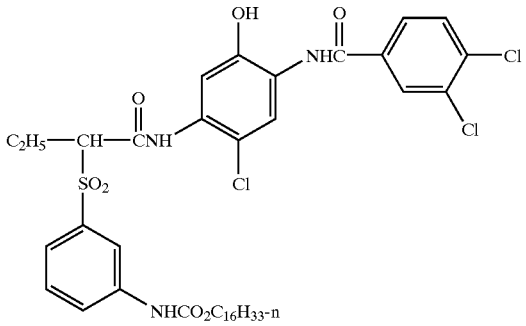
-continued
IC-21
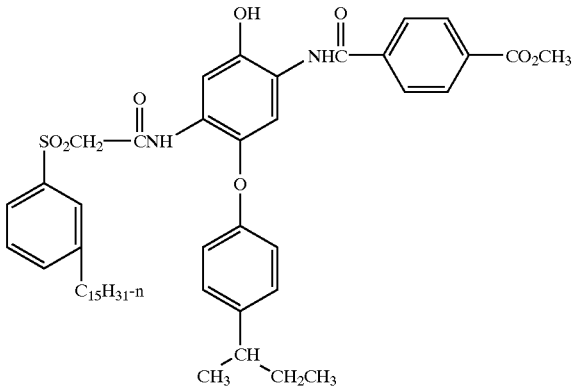
IC-22
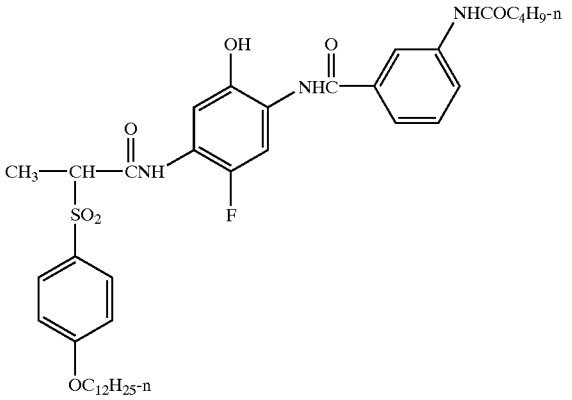
IC-23
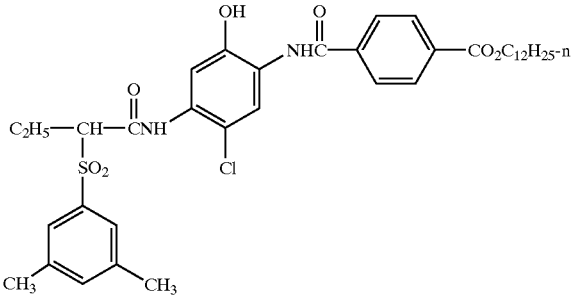
IC-24
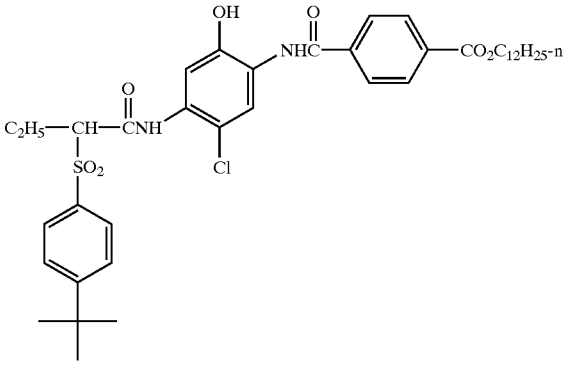

-continued
IC-25
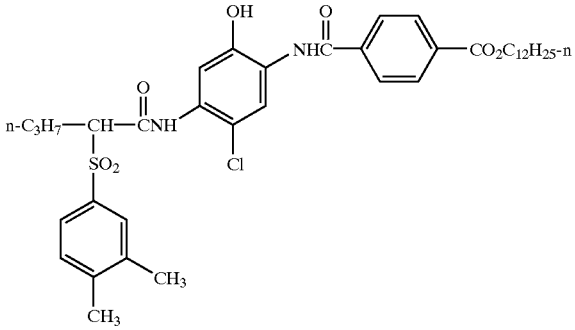
IC-26
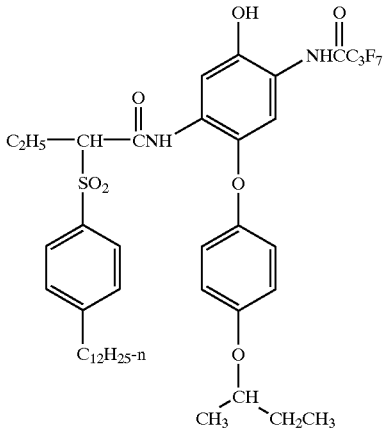
IC-27
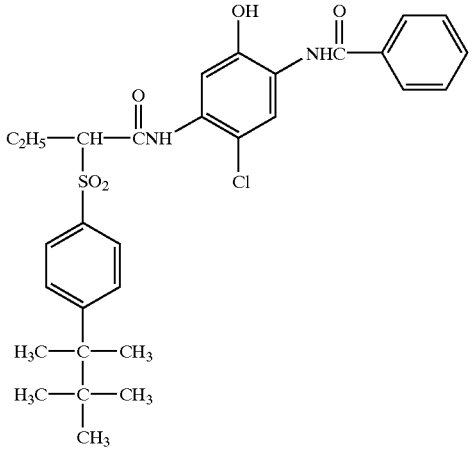
IC-28
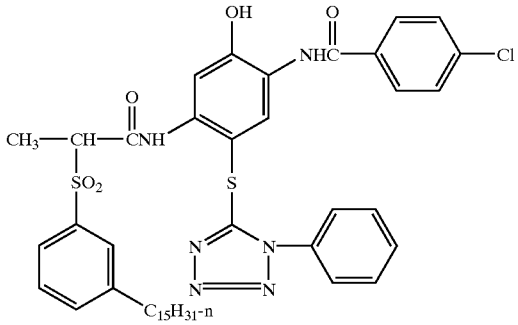
-continued
IC-29
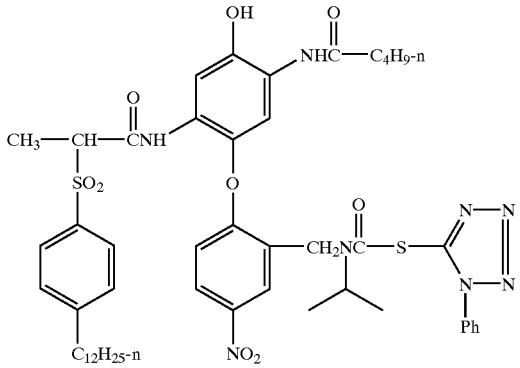
IC-30
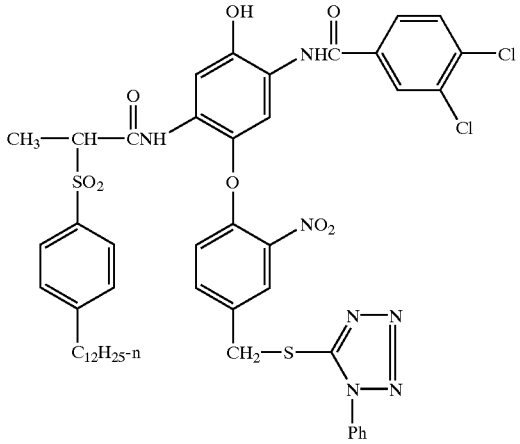
IC-31
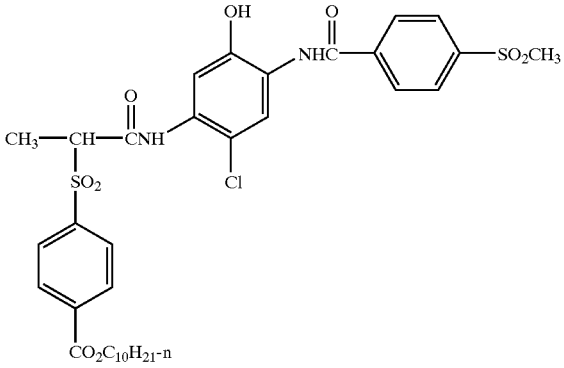
IC-32
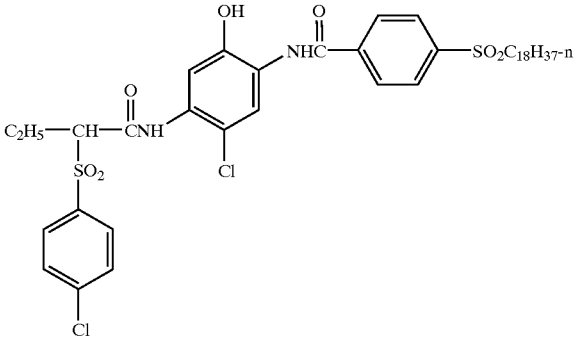

-continued
IC-33
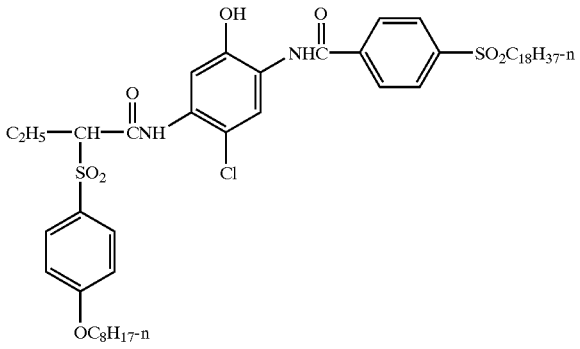
IC-34
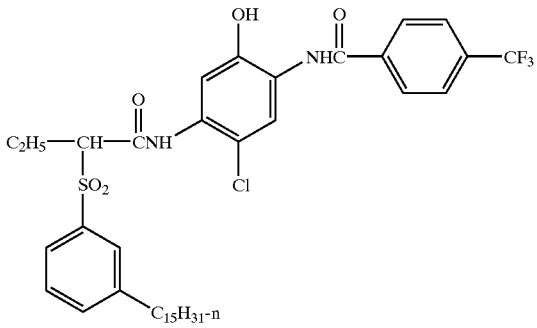
IC-35
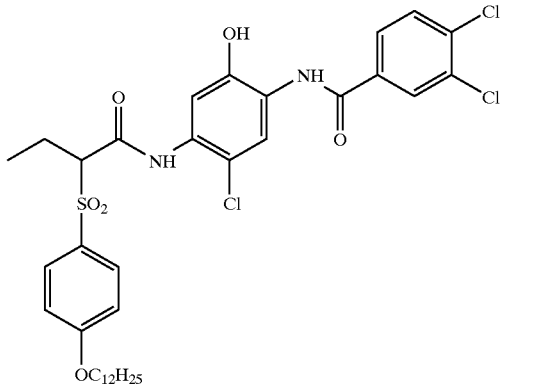
IC-36
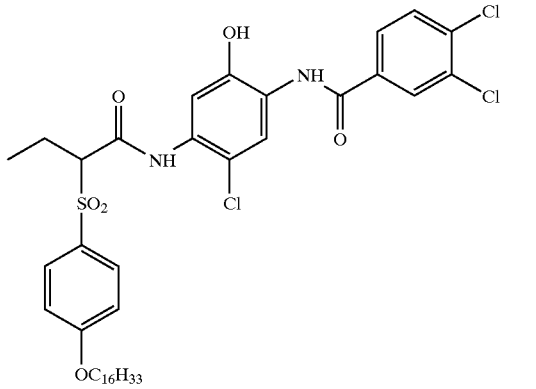
-continued
IC-37
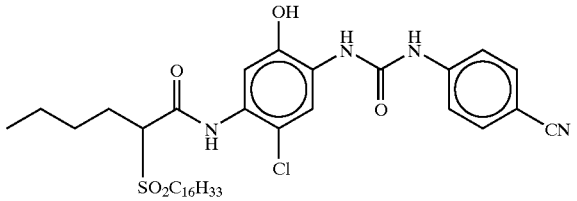
IC-38
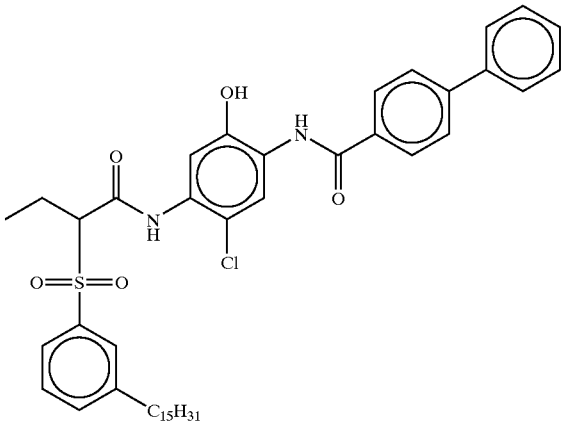
IC-39
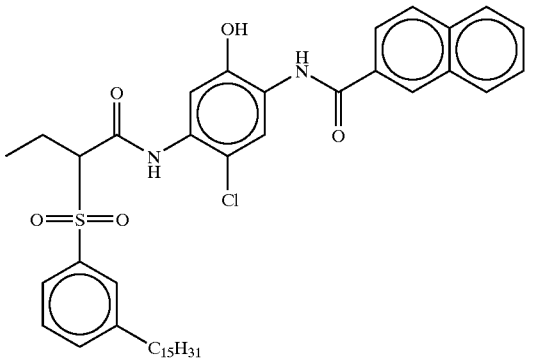
IC-40
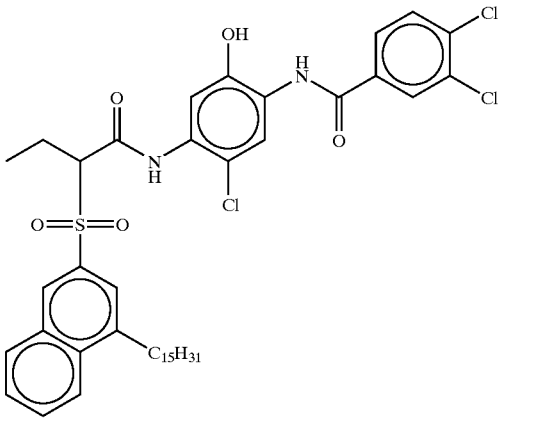
Preferred couplers are IC-3, IC-7, IC-35, and IC-36 because of their suitably narrow left bandwidths.

Couplers that form magenta dyes upon reaction with oxidized color developing agent are described in such representative patents and publications as: U.S. Pat. Nos. 2,311,082; 2,343,703; 2,369,489; 2,600,788; 2,908,573; 3,062,653; 3,152,896; 3,519,429; 3,758,309; and "Farbkuppler-eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents. Especially preferred couplers are 1H-pyrazolo[5,1-c]-1,2,4-triazole and 1H-pyrazolo[1,5-b]-1,2,4-triazole. Examples of 1H-pyrazolo[5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo[1,5-b]-1,2,4-triazoles can be found in European Patent applications 176,804; 177,765; U.S. Pat. Nos. 4,659,652; 5,066,575; and 5,250,400.

Typical pyrazoloazole and pyrazolone couplers are represented by the following formulas:

MAGENTA-1

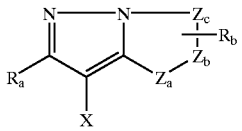

MAGENTA-2

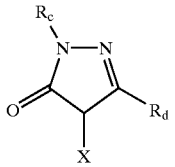

wherein $R_a$ and $R_b$ independently represent H or a substituent; $R_c$ is a substituent (preferably an aryl group); $R_d$ is a substituent (preferably an anilino, carbonamido, ureido, carbamoyl, alkoxy, aryloxycarbonyl, alkoxycarbonyl, or N-heterocyclic group); X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ represents a methine group connected to the group $R_b$.

Specific examples of such couplers are:

M-1

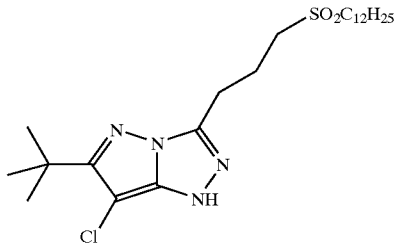

-continued

M-2

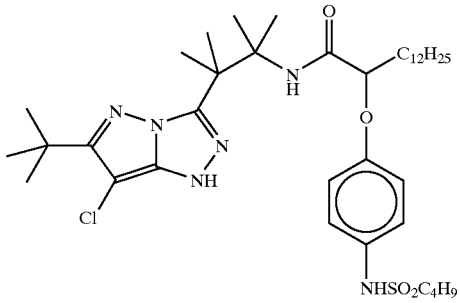

M-3

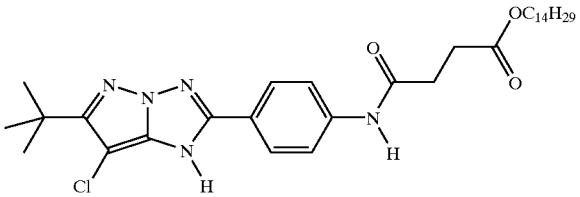

M-4

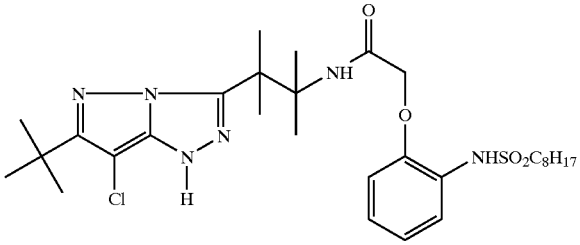

M-5

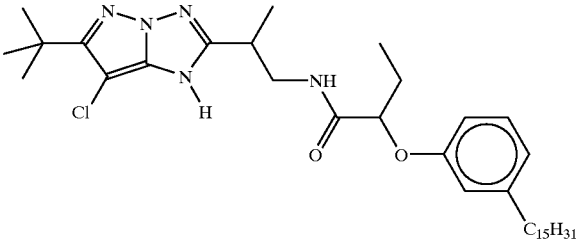

Couplers that form yellow dyes upon reaction with oxidized color developing agent are described in such representative patents and publications as: U.S. Pat. Nos. 2,298,443; 2,407,210; 2,875,057; 3,048,194; 3,265,506; 3,447,928; 3,960,570; 4,022,620; 4,443,536; 4,910,126; and 5,340,703 and "Farbkuppler-eine Literature Ubersicht," published in Agfa Mitteilungen, Band III, pp. 112–126 (1961). Such couplers are typically open chain ketomethylene compounds. Also preferred are yellow couplers such as described in, for example, European Patent Application Nos. 482,552; 510,535; 524,540; 543,367; and U.S. Pat. No. 5,238,803. For improved color reproduction, couplers which give yellow dyes that cut off sharply on the long wavelength side are particularly preferred (for example, see U.S. Pat. No. 5,360,713).

Typical preferred yellow couplers are represented by the following formulas:

YELLOW-1

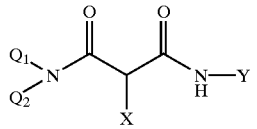

YELLOW-2

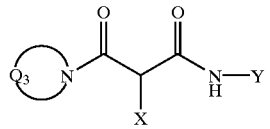

YELLOW-3

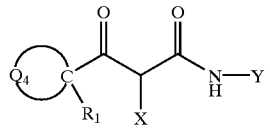

YELLOW-4

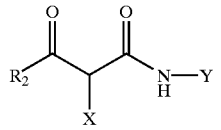

wherein $R_1$, $R_2$, $Q_1$ and $Q_2$ each represents a substituent; X is hydrogen or a coupling-off group; Y represents an aryl group or a heterocyclic group; $Q_3$ represents an organic residue required to form a nitrogen-containing heterocyclic group together with the >N—; and $Q_4$ represents nonmetallic atoms necessary to from a 3- to 5-membered hydrocarbon ring or a 3- to 5-membered heterocyclic ring which contains at least one hetero atom selected from N, O, S, and P in the ring. Particularly preferred is when $Q_1$ and $Q_2$ each represents an alkyl group, an aryl group, or a heterocyclic group, and $R_2$ represents an aryl or tertiary alkyl group.

Preferred yellow couplers can be of the following general structures:

Y-1

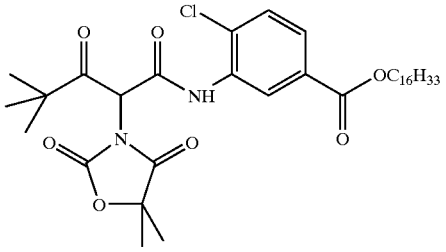

Y-2

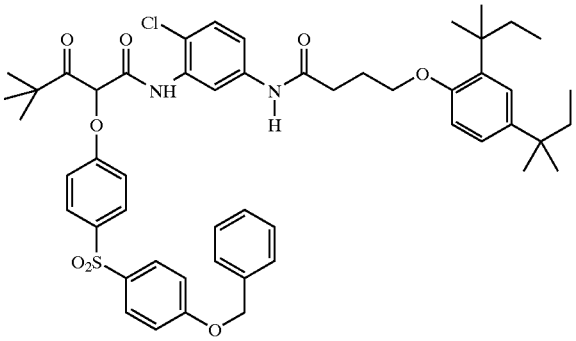

-continued

Y-3

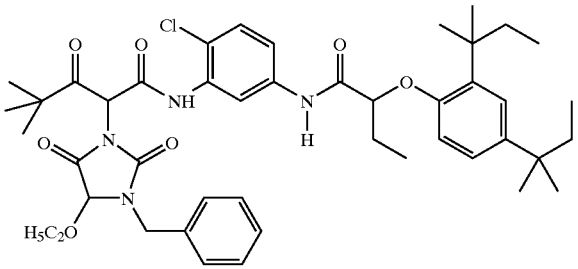

Y-4

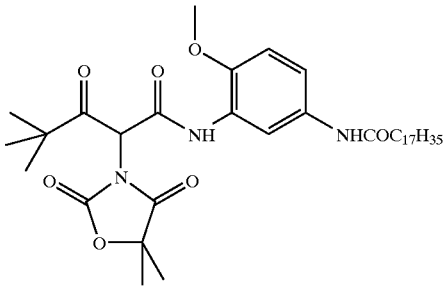

Y-5

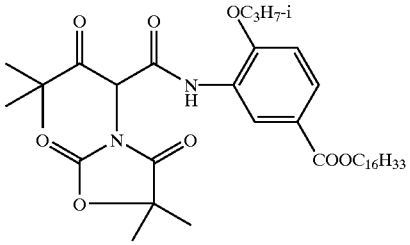

Y-6

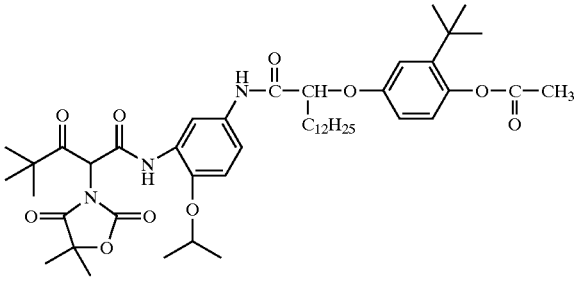

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy)propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)

ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl)carbonyl amino, p-dodecyl-phenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl, methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amino, such as phenylanilino, 2-chloroanilino, diethylamino, dodecylamino; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3- to 7-membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups. Generally, the above groups and substituents thereof may include those having up to 48 carbon atoms, typically 1 to 36 carbon atoms and usually less than 24 carbon atoms, but greater numbers are possible depending on the particular substituents selected.

Representative substituents on ballast groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

Stabilizers and scavengers that can be used with the present invention, but are not limited to, the following:

ST-1

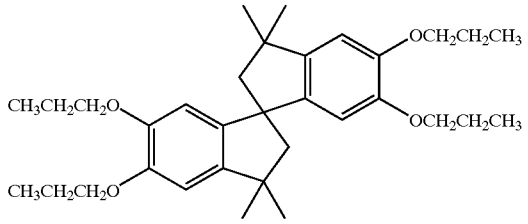

ST-2

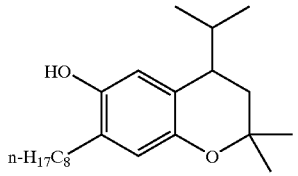

-continued
ST-3
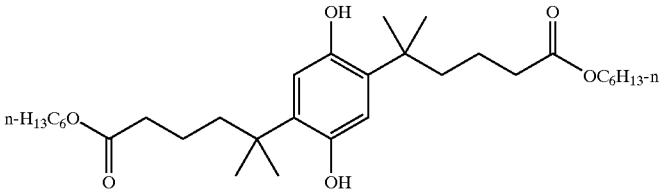
ST-4
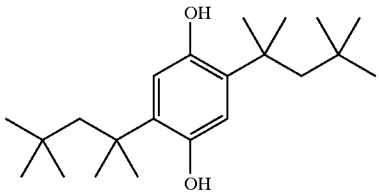
ST-5
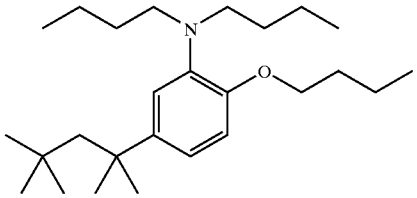
ST-6
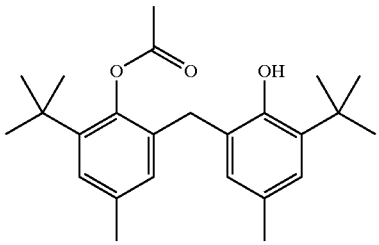
ST-7
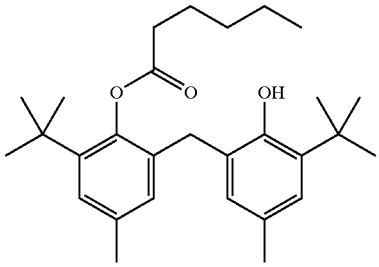
ST-8
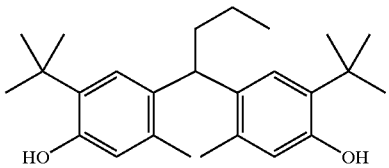
ST-9
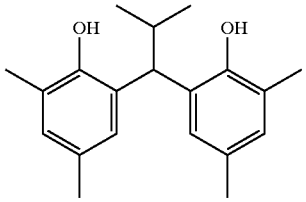

-continued
ST-10
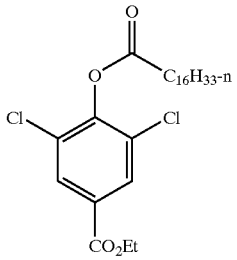
ST-11
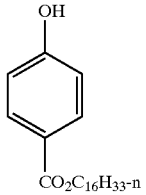
ST-12
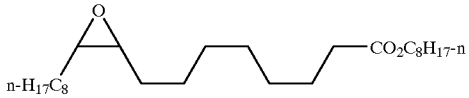
ST-13
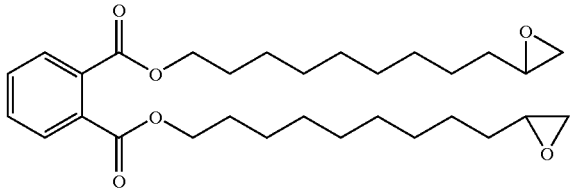
ST-14
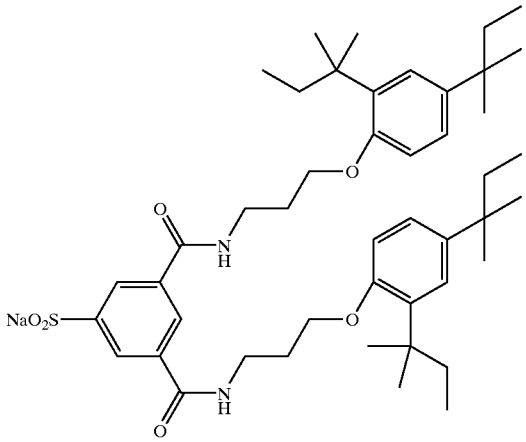
ST-15
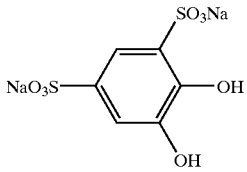
ST-16
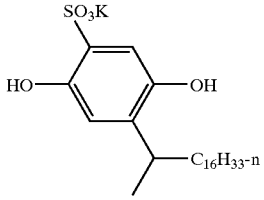

-continued

ST-17

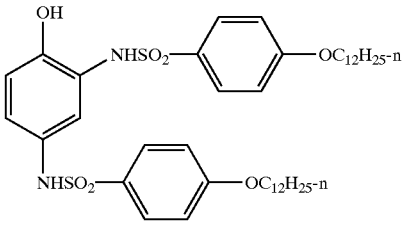

ST-18

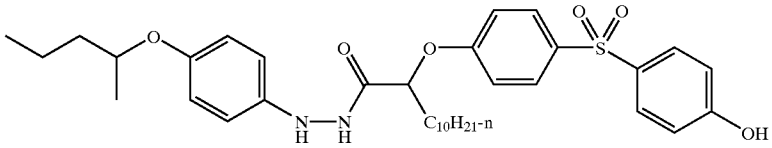

ST-19

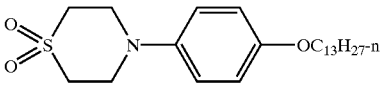

ST-20

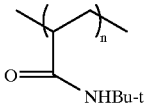

n = 75–8,000

ST-21

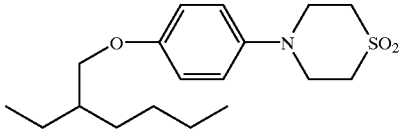

ST-22

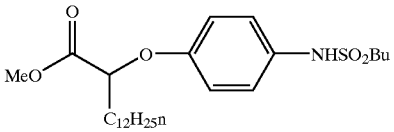

ST-23

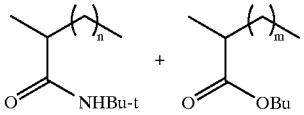

n:m 1:1 mw = 75–100,000

ST-24

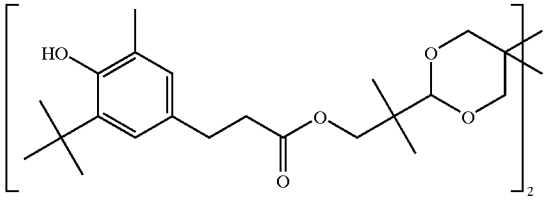

Examples of solvents which may be used in the invention include the following:

| | |
|---|---|
| Tritolyl phosphate | S-1 |
| Dibutyl phthalate | S-2 |
| Diundecyl phthalate | S-3 |
| N,N-Diethyldodecanamide | S-4 |
| N,N-Dibutyldodecanamide | S-5 |
| Tris(2-ethylhexyl)phosphate | S-6 |
| Acetyl tributyl citrate | S-7 |
| 2,4-Di-tert-pentylphenol | S-8 |

-continued

| | |
|---|---|
| 2-(2-Butoxyethoxy)ethyl acetate | S-9 |
| 1,4-Cyclohexyldimethylene bis(2-ethylhexanoate) | S-10 |

The dispersions used in photographic elements useful with the present invention may also include ultraviolet (UV) stabilizers and so-called liquid UV stabilizers such as described in U.S. Pat. Nos. 4,992,358; 4,975,360; and 4,587,346. Examples of UV stabilizers are shown below.

UV-1
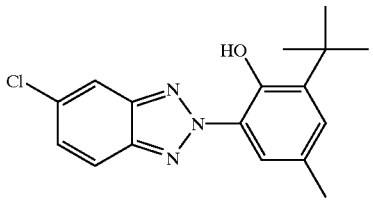
UV-2
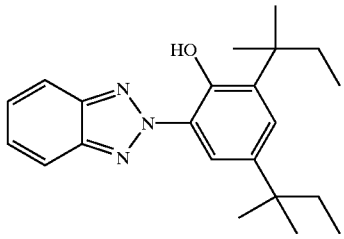
UV-3
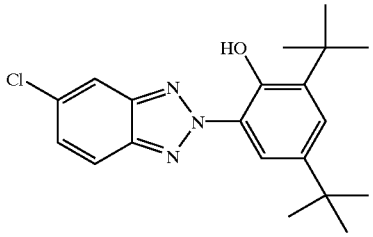
UV-4
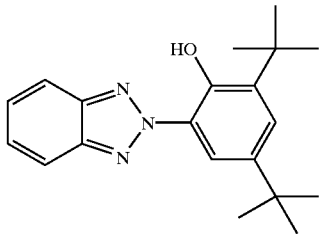
UV-5
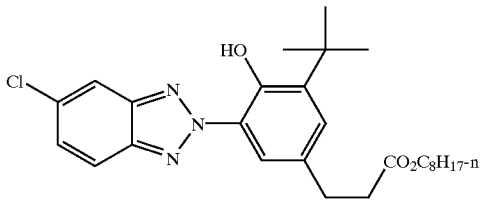
UV-6
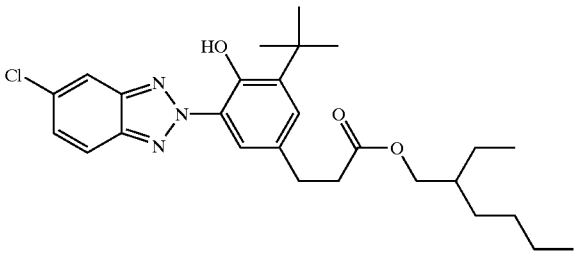
UV-7
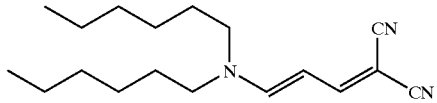
-continued
UV-8
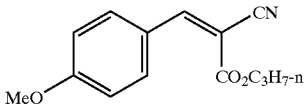
The aqueous phase may include surfactants. Surfactant may be cationic, anionic, zwitterionic or non-ionic. Useful surfactants include, but are not limited to, the following:
SF-1
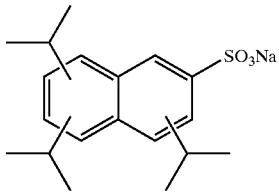
SF-2
$CF_3 \cdot (CF_2)_7 \cdot SO_3Na$
SF-3
$CH_3 \cdot (CH_2)_n \cdot SO_3Na$,
n = 12–14
SF-4
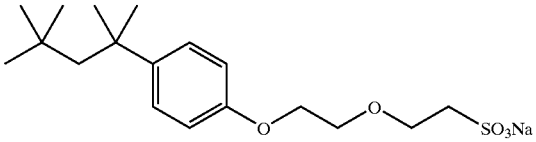
SF-5
$CH_3 \cdot (CH_2)_{11} \cdot OSO_3Na$
SF-6
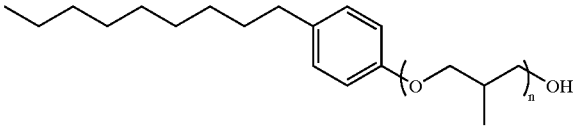
n = ca. 10
SF-7
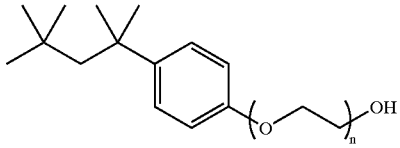
n = ca. 40
SF-8
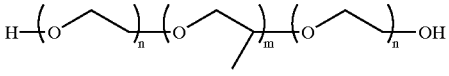
n = ca. 6, m = ca. 2
SF-9
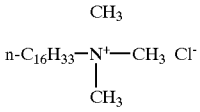
SF-10
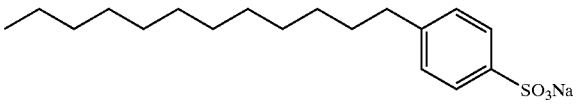

-continued

SF-11

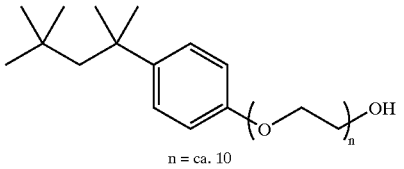

n = ca. 10

SF-12

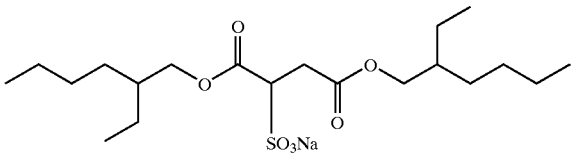

Further, it is contemplated to stabilize photographic dispersions prone to particle growth through the use of hydrophobic, photographically inert compounds such as disclosed by Zengerle et al U.S. Pat. No. 5,468,604.

In a preferred embodiment the invention employs recording elements which are constructed to contain at least three silver halide emulsion and preferably six layer units. A suitable full color, multilayer format for a recording element used in the invention is represented by Structure I.

| STRUCTURE I<br>Red-sensitized cyan dye image-forming silver halide emulsion unit |
|---|
| Interlayer<br>Green-sensitized magenta dye image-forming silver halide emulsion unit<br>Interlayer<br>Blue-sensitized yellow dye image-forming silver halide emulsion unit<br>///// Support containing inorganic clay /////<br>Blue-sensitized yellow dye image-forming silver halide emulsion unit<br>Interlayer<br>Green-sensitized magenta dye image-forming silver halide emulsion unit<br>Interlayer<br>Red-sensitized cyan dye image-forming silver halide emulsion unit |

The image-forming units are separated from each other by hydrophilic colloid interlayers containing an oxidized developing agent scavenger to prevent color contamination. Silver halide emulsions satisfying the grain and gelatino-peptizer requirements described above can be present in any one or combination of the emulsion layer units. Additional useful multicolor, multilayer formats for an element of the invention include structures as described in U.S. Pat. No. 5,783,373. Each of such structures in accordance with the invention preferably would contain six silver halide emulsions comprised of high chloride grains having at least 50 percent of their surface area bounded by {100} crystal faces and containing dopants from classes (i) and (ii), as described above. Preferably each of the emulsion layer units contains emulsion satisfying these criteria.

Conventional features that can be incorporated into multilayer (and particularly multicolor) recording elements contemplated for use in the invention are illustrated by *Research Disclosure*, Item 38957, cited above:

XI. Layers and layer arrangements

XII. Features applicable only to color negative

XIII. Features applicable only to color positive

B. Color reversal

C. Color positives derived from color negatives

XIV. Scan facilitating features.

The recording elements comprising the radiation sensitive high chloride emulsion layers useful with this invention can be conventionally optically printed, or in accordance with a particular embodiment of the invention can be image-wise exposed in a pixel-by-pixel mode using suitable high energy radiation sources typically employed in electronic printing methods. Suitable actinic forms of energy encompass the ultraviolet, visible, and infrared regions of the electromagnetic spectrum, as well as electron-beam radiation and is conveniently supplied by beams from one or more light emitting diodes or lasers, including gaseous or solid state lasers. Exposures can be monochromatic, orthochromatic, or panchromatic. For example, when the recording element is a multilayer multicolor element, exposure can be provided by laser or light emitting diode beams of appropriate spectral radiation, for example, infrared, red, green or blue wavelengths, to which such element is sensitive. Multicolor elements can be employed which produce cyan, magenta and yellow dyes as a function of exposure in separate portions of the electromagnetic spectrum, including at least two portions of the infrared region, as disclosed in the previously mentioned U.S. Pat. No. 4,619,892. Suitable exposures include those up to 2000 nm, preferably up to 1500 nm. Suitable light emitting diodes and commercially available laser sources are known and commercially available. Imagewise exposures at ambient, elevated, or reduced temperatures and/or pressures can be employed within the useful response range of the recording element determined by conventional sensitometric techniques, as illustrated by T. H. James, *The Theory of the Photographic Process*, 4th Ed., Macmillan, 1977, Chapters 4, 6, 17, 18, and 23.

It has been observed that anionic $[MX_xY_yL_z]$ hexacoordination complexes, where M is a group 8 or 9 metal (preferably iron, ruthenium or iridium), X is halide or pseudohalide (preferably Cl, Br, or CN) x is 3 to 5, Y is $H_2O$, y is 0 or 1, L is a C—C, H—C or C—N—H organic ligand, and Z is 1 or 2, are surprisingly effective in reducing high intensity reciprocity failure (HIRF), low intensity reciprocity failure (LIRF) and thermal sensitivity variance and in an improving latent image keeping (LIK). As herein employed, HIRF is a measure of the variance of photographic properties for equal exposures, but with exposure times ranging from $10^{-1}$ to $10^{-6}$ second. LIRF is a measure of the variance of photographic properties for equal exposures, but with exposure times ranging from $10^{-1}$ to 100 seconds. Although these advantages can be generally compatible with face centered cubic lattice grain structures, the most striking improvements have been observed in high (>50 mole %, preferably >90 mole %) chloride emulsions. Preferred C—C, H—C, or C—N—H organic ligands are aromatic heterocycles of the type described in U.S. Pat. No. 5,462,849. The most effective C—C, H—C, or C—N—H organic ligands are azoles and azines, either unsubstituted or containing alkyl, alkoxy, or halide substituents, where the alkyl moieties contain from 1 to 8 carbon atoms. Particularly preferred azoles and azines include thiazoles, thiazolines, and pyrazines.

The quantity or level of high energy actinic radiation provided to the recording medium by the exposure source is generally at least $10^{-4}$ ergs/cm$^2$, typically in the range of $10^{-4}$ ergs/cm$^2$ to $10^{-3}$ ergs/cm$^2$ and often from $10^{-3}$ ergs/cm$^2$ to $10^2$ ergs/cm$^2$. Exposure of the recording element in a pixel-by-pixel mode as known in the prior art persists for only a very short duration or time. Typical maximum exposure times are up to 100 $\mu$seconds, often up to 10 $\mu$seconds, and frequently up to only 0.5$\mu$seconds. Single or multiple exposures of each pixel are contemplated. The pixel density is subject to wide variation, as is obvious to those skilled in the art. The higher the pixel density, the sharper the images can be, but at the expense of equipment complexity. In general, pixel densities used in conventional electronic printing methods of the type described herein do not exceed $10^7$ pixels/cm$^2$ and are typically in the range of $10^4$ to $10^6$ pixels/cm$^2$. An assessment of the technology of high-quality, continuous-tone, color electronic printing using silver halide photographic paper which discusses various features and components of the system, including exposure source, exposure time, exposure level and pixel density and other recording element characteristics is provided in Firth et al., *A Continuous-Tone Laser Color Printer*, Journal of Imaging Technology, Vol. 14, No. 3, June 1988. As previously indicated herein, a description of some of the details of conventional electronic printing methods comprising scanning a recording element with high energy beams such as light emitting diodes or laser beams, is set forth in Hioki U.S. Pat. No. 5,126,235 and European Patent Applications 479 167 A1 and 502 508 A1.

Once imagewise exposed, the recording elements can be processed in any convenient conventional manner to obtain a viewable image. Such processing is illustrated by *Research Disclosure*, Item 38957, cited above:

XVIII. Chemical development systems

XIX. Development

XX. Desilvering, washing, rinsing, and stabilizing

In addition, a useful developer for the inventive material is a homogeneous, single-part developing agent. The homogeneous, single-part color developing concentrate is prepared using a critical sequence of steps:

In the first step, an aqueous solution of a suitable color developing agent is prepared. This color developing agent is generally in the form of a sulfate salt. Other components of the solution can include an antioxidant for the color developing agent, a suitable number of alkali metal ions (in an at least stoichiometric proportion to the sulfate ions) provided by an alkali metal base, and a photographically inactive water-miscible or water-soluble hydroxy-containing organic solvent. This solvent is present in the final concentrate at a concentration such that the weight ratio of water to the organic solvent is from 15:85 to 50:50.

In this environment, especially at high alkalinity, alkali metal ions and sulfate ions form a sulfate salt that is precipitated in the presence of the hydroxy-containing organic solvent. The precipitated sulfate salt can then be readily removed using any suitable liquid/solid phase separation technique (including filtration, centrifugation, or decantation). If the antioxidant is a liquid organic compound, two phases may be formed and the precipitate may be removed by discarding the aqueous phase.

The color developing concentrates useful with this invention include one or more color developing agents that are well known in the art that, in oxidized form, will react with dye forming color couplers in the processed materials. Such color developing agents include, but are not limited to, aminophenols, p-phenylenediamines (especially N,N-dialkyl-p-phenylenediamines) and others which are well known in the art, such as EP 0 434 097 A1 (published June 26, 1991) and EP 0 530 921 A1 (published March 10, 1993). It may be useful for the color developing agents to have one or more water-solubilizing groups as are known in the art. Further details of such materials are provided in *Research Disclosure*, 38957, pages 592–639 (September 1996). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*".

Preferred color developing agents include, but are not limited to, N,N-diethyl p-phenylenediamine sulfate (KODAK Color Developing Agent CD-2), 4-amino-3-methyl-N-(2-methane sulfonamidoethyl)aniline sulfate, 4-(N-ethyl-N-σ-hydroxyethylamino)-2-methylaniline sulfate (KODAK Color Developing Agent CD-4), p-hydroxyethylethylaminoaniline sulfate, 4-(N-ethyl-N-2-methanesulfonylaminoethyl)-2-methylphenylenediamine sesquisulfate (KODAK Color Developing Agent CD-3), 4-(N-ethyl-N-2-methanesulfonylaminoethyl)-2-methylphenylenediamine sesquisulfate, and others readily apparent to one skilled in the art.

In order to protect the color developing agents from oxidation, one or more antioxidants are generally included in the color developing compositions. Either inorganic or organic antioxidants can be used. Many classes of useful antioxidants are known, including but not limited to, sulfites (such as sodium sulfite, potassium sulfite, sodium bisulfite and potassium metabisulfite), hydroxylamine (and derivatives thereof), hydrazines, hydrazides, amino acids, ascorbic acid (and derivatives thereof), hydroxamic acids, aminoketones, mono- and polysaccharides, mono- and polyamines, quaternary ammonium salts, nitroxy radicals, alcohols, and oximes. Also useful as antioxidants are 1,4-cyclohexadiones. Mixtures of compounds from the same or different classes of antioxidants can also be used if desired.

Especially useful antioxidants are hydroxylamine derivatives as described, for example, in U.S. Pat. Nos. 4,892,804; 4,876,174; 5,354,646; and 5,660,974, all noted above, and U.S. Pat. No. 5,646,327 (Bums et al). Many of these antioxidants are mono- and dialkylhydroxylamines having one or more substituents on one or both alkyl groups. Particularly useful alkyl substituents include sulfo, carboxy, amino, sulfonamido, carbonamido, hydroxy, and other solubilizing substituents.

More preferably, the noted hydroxylamine derivatives can be mono- or dialkylhydroxylamines having one or more hydroxy substituents on the one or more alkyl groups. Representative compounds of this type are described, for example, in U.S. Pat. No. 5,709,982 (Marrese et al), as having the structure AI:

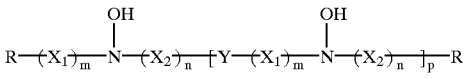

wherein R is hydrogen, a substituted or unsubstituted alkyl group of 1 to 10 carbon atoms, a substituted or unsubstituted hydroxyalkyl group of 1 to 10 carbon atoms, a substituted or unsubstituted cycloalkyl group of 5 to 10 carbon atoms, or a substituted or unsubstituted aryl group having 6 to 10 carbon atoms in the aromatic nucleus.

$X_1$ is —$CR_2(OH)CHR_1$— and $X_2$ is —$CHR_1CR_2(OH)$— wherein $R_1$ and $R_2$ are independently hydrogen, hydroxy, a substituted or unsubstituted alkyl group or 1 or 2 carbon atoms, a substituted or unsubstituted hydroxyalkyl group of 1 or 2 carbon atoms, or $R_1$ and $R_2$ together represent the carbon atoms necessary to complete a substituted or unsubstituted 5- to 8-membered saturated or unsaturated carbocyclic ring structure.

Y is a substituted or unsubstituted alkylene group having at least 4 carbon atoms, and has an even number of carbon atoms, or Y is a substituted or divalent aliphatic group having an even total number of carbon and in the chain, provided that the aliphatic group has a least 4 atoms in Also in Structure AI, m, n, and p are independently 0 or 1. Preferably each of m and n is 1, and p is 0. Specific di-substituted hydroxylamine antioxidants include, but are not limited to, N,N-bis(2,3-dihydroxypropyl) hydroxylamide, N,N-bis(2-methyl-2,3-dihydroxypropyl) hydroxylamine, and N,N-bis(1-hydroxymethyl-2-hydroxy-3-phenylpropyl)hydroxylamine. The first referred.

In the following Table, reference will be made to (1) *Research Disclosure*, December 1978, Item 17643, (2) *Research Disclosure*, December 1989, Item 30119, and (3) *Research Disclosure*, September 1994, Item 36544, all published by Kenneth Mason Publications, Ltd., Dudley Annex, 12a North Street, Emsworth, Hampshire PO10 7DQ, ENGLAND. The Table and the references cited in the Table are to be read as describing particular components suitable for use with the invention. The Table and its cited references also describe suitable ways of preparing, exposing, processing and manipulating the elements, and the images contained therein.

| Reference | Section | Subject Matter |
|---|---|---|
| 1 | I, II | Grain composition, morphology |
| 2 | I, II, IX, X, XI, XII, XIV, XV | and preparation. Emulsion preparation including hardeners, |
| | I, II, III, IX | coating aids, addenda, etc. |
| 3 | A & B | |
| 1 | III, IV | Chemical sensitization and |
| 2 | III, IV | spectral sensitization/ |
| 3 | IV, V | Desensitization |
| 1 | V | UV dyes, optical brighteners, |
| 2 | V | luminescent dyes |
| 3 | VI | |
| 1 | VI | |
| 2 | VI | Antifoggants and stabilizers |
| 3 | VII | |
| 1 | VIII | Absorbing and scattering |
| 2 | VIII, XIII, XVI | materials; Antistatic layers; |
| 3 | VIII, IX C & D | matting agents |
| 1 | VII | Image-couplers and image- |
| 2 | VII | modifying couplers; Dye |
| 3 | X | stabilizers and hue modifiers |
| 1 | XVII | Supports |
| 2 | XVII | |
| 3 | XV | |
| 3 | XI | Specific layer arrangements |
| 3 | XII, XIII | Negative working emulsions; Direct positive emulsions |
| 2 | XVIII | Exposure |
| 3 | XVI | |
| 1 | XIX, XX | Chemical processing; |
| 2 | XIX, XX, XXII | Developing agents |
| 3 | XVIII, XIX, XX | |
| 3 | XIV | Scanning and digital processing procedures |

The photographic elements can be exposed with various forms of energy which encompass the ultraviolet, visible, and infrared regions of the electromagnetic spectrum, as well as with electron beam, beta radiation, gamma radiation, x-ray alpha particle, neutron radiation, and other forms of corpuscular and wave-like radiant energy in either noncoherent (random phase) forms or coherent (in phase) forms, as produced by lasers. When the photographic elements are intended to be exposed by x-rays, they can include features found in conventional radiographic element.

This allows for traditional image processing equipment to be used. The imaging elements of this invention can be exposed via traditional optical methods using a negative, but they are preferably exposed by means of a collimated beam, to form a latent image, and then processed to form a visible image, preferably by other than heat treatment. A collimated beam is preferred as it allows for digital printing and simultaneous exposure of the imaging layer on the top and bottom side without significant internal light scatter. A preferred example of a collimated beam is a laser also known as light amplification by stimulated emission of radiation. The laser may be preferred because this technology is used widely in a number of digital printing equipment types. Further, the laser provides sufficient energy to simultaneously expose the light sensitive silver halide coating on the top and bottom side of the display material of this invention without undesirable light scatter. Subsequent processing of the latent image into a visible image is preferably carried out in the known RA-4™ (Eastman Kodak Company) process or other processing systems suitable for developing high chloride emulsions.

The following examples illustrate the practice of this invention. They are not intended to be exhaustive of all possible variations of the invention. Parts and percentages are by weight unless otherwise indicated.

The following examples are provided to illustrate the invention.

EXAMPLE 1

In this example the invention is compared to a typical prior art transmission display material, Kodak Duratrans™ that has a polyester terephthalate base with cyan, magenta, and yellow dye forming emulsion layers on one side. The invention is a duplitized silver halide emulsion coating polyester support containing Na Cloisite clay, which is a natural montmorillonite having a distribution of particle sizes with a distribution of aspect ratios of from 1000:1 to 20:1, with a distribution of lateral dimension of 0.1–1.0 micron (am) or 100–1000 nm and a distribution of vertical dimension of from 0.001 to 0.005 micron or 1–5 nm. The prior art material and the invention were measured for % transmission, lightness, color, and illuminant show through. This example will show a reduction in the yellowness of the base and a reduction in developer time compared to the prior art materials.

The following photographic transmission display material of the invention was prepared by coextrusion of a biaxially oriented polyester sheet containing a skin layer with 2% weight addition Na Cloisite clay supplied by Southern Clay Products. The intercalant used consisted of PEO-b-PCL, a block copolymer poly(ethylene oxide-b-caprolactone), with PEO:PCL molecular weight ratio of 5000:20000.

The base core of this structure was a clear polyester that was subbed on the bottommost side with an adhesion promoting gelatin based material to enhance the adhesion of gelatin from the light sensitive emulsion to the imaging member. The same adhesion promoting material was subbed on the outer surface of said polyester skin layer containing the clay. An optical brightener was added in layer L2 at 0.05% by weight of base polymer. The optical brightener used was Hostalux KS manufactured by Ciba-Geigy. Rutile $TiO_2$ was added to the L2 at 0.5% by weight of base polymer. The $TiO_2$ type was DuPont R104 (a 0.22 micrometer particle size $TiO_2$). Shepperd blue dye 125A was also added in layer L2 at 0.005% by weight of base polymer. Table 1 below lists the characteristics oriented polyester sheet used in this example.

TABLE 1

| | | |
|---|---|---|
| L1 | Gel Sub Layer | 0.7 micrometers |
| L2 | Polyester containing 2% Na Cloisite clay, $TiO_2$, optical brightener and blue dye | 8 micrometers |
| L3 | Polyester | 150 micrometers |
| L4 | Gel Sub Layer | 0.7 micrometers |

The display materials were processed without exposure to obtain a minimum density. The display support was measured for status A density using an X-Rite Model 310 photographic densitometer. Spectral transmission is calculated from the Status A density readings and is the ratio of the transmitted power to the incident power and is expressed as a percentage as follows; $T_{RGB}=10^{-D}*100$ where D is the average of the red, green, and blue Status A transmission density response. The display material were also measured for L*, a*, and b* using a Spectrogard spectrophotometer, CIE system, using illuminant D6500. In the transmission mode, a qualitative assessment was made as to the amount of illuminating backlighting show through. A substantial amount of lamp show through would be considered undesirable, as the back illuminating light sources could interfere with the image quality. The data for invention are listed in Table 4 below.

TABLE 4

| Measurement | Invention Value | Prior Art Value |
|---|---|---|
| % Transmission | 58% | 51% |
| CIE D6500 L* | 83.00 | 74.03 |
| CIE D6500 a* | −0.17 | −0.06 |
| CIE D6500 b* | −3.25 | 7.00 |
| Illuminating Backlight Show through | None | None |

The reflection/transmission display support coated on the top and bottom sides with the light sensitive silver halide coating format of this invention example exhibits all the properties needed for an photographic display material that can function as both a reflective and transmission display material. Further, the invention photographic reflection/transmission display material of this example has many advantages over prior art photographic display materials. The layer containing the Na Cloisite clay had levels of $TiO_2$ and colorants adjusted to provide an improved minimum density position compared to prior art reflection display materials or prior art transmission display materials, as the invention was able to overcome the native yellowness of the processed emulsion layers (b* for the invention was −3.15 compared to a b* of 7.0 for the comparison prior art transmission material). In the transmission mode, the illuminating backlights did not show through indicating an acceptable transmission product.

The % transmission for the invention (58%) provides an acceptable reflection image and allows enough light through the support to be an acceptable transmission image. A display material that functions as both transmission materials and reflective materials has significant commercial value, as the quality of the display image is robust to lighting factors. Further, the layer containing the Na Cloisite clay provided high ambient light diffusion allowing the front silver halide formed image to be visually separated from the back silver halide formed image allowing the image to be viewed without rear illumination while simultaneously allowing transmitted light through the duplitized image without allowing the illuminating light source to show through the image. Further, the 58% light transmission for the invention material allows for better exposure of the backside image compared to prior art organic particle voided supports. The better exposure of the backside image creates a display system with better image density in transmission and a preferred lower density image on the top image compared to organic particle voided supports.

Contemplated coatings 2-1 to 2-6 were prepared as described in Table 5.

TABLE 5

| Variation Comment | 2-1 Check | 2-2 Check | 2-3 Invention | 2-4 Invention | 2-5 Invention | 2-6 Invention |
|---|---|---|---|---|---|---|
| Front SOC | SOC-1 | SOC-1 | SOC-1 | SOC-1 | SOC-1 | SOC-1 |
| UV Layer | UV-1 | UV-1 | UV-1 | UV-1 | UV-1 | UV-1 |
| Red Layer | RL-1 | RL-1 | RL-2 | RL-2 | RL-2 | RL-2 |
| UV Interlayer | UV IL-1 | UV IL-1 | UV IL-1 | UV IL-1 | UV IL-1 | UV IL-1 |
| Green Layer | GL-1 | GL-1 | GL-2 | GL-2 | GL-2 | GL-2 |
| Interlayer | IL-1 | IL-1 | IL-1 | IL-1 | IL-1 | IL-1 |
| Yellow Layer | SY-1 | SY-1 | SY-1 | SY-1 | SY-1 | None |
| Blue Layer | BL-1 | BL-1 | BL-2 | BL-2 | BL-2 | BL-3 |
| Support containing clay diffuser layer | S-1 | S-1 | S-1 | S-1 | S-1 | S-1 |
| Blue Layer | BL-1 | BL-1 | BL-2 | BL-2 | BL-2 | BL-3 |
| Yellow Layer | SY-1 | SY-1 | SY-1 | SY-1 | SY-1 | None |
| Interlayer | IL-1 | IL-1 | IL-1 | IL-1 | IL-1 | IL-1 |
| Green Layer | GL-1 | GL-1 | GL-2 | GL-2 | GL-2 | GL-2 |
| UV Interlayer | UV IL-1 | UV IL-1 | UV IL-1 | UV IL-1 | UV IL-1 | UV IL-1 |
| Red Layer | RL-1 | RL-1 | RL-2 | RL-2 | RL-2 | RL-2 |
| Tone Enhancing Layer | UV-1 | UV-1 | UV-1 | TEL-1 | TEL-2 | TEL-2 |
| Back SOC | SOC-2 | SOC-3 | SOC-4 | SOC-5 | SOC-5 | SOC-5 |

The following layer formulations are prepared by methods well known to the art. All material lay downs are expressed in terms of $g/m^2$.

BL-1: Blue Sensitive Layer

| | |
|---|---|
| Gelatin | 1.184 |
| Blue Sensitive Silver | 0.280 |
| Y-1 | 0.452 |
| ST-1 | 0.078 |
| ST-2 | 0.026 |
| Diundecyl phthalate | 0.198 |

BL-2: Blue Sensitive Layer

| | |
|---|---|
| Gelatin | 1.306 |
| Blue Sensitive Silver | 0.350 |
| Y-1 | 0.452 |
| ST-1 | 0.078 |
| ST-2 | 0.026 |
| Diundecyl phthalate | 0.198 |

BL-3: Blue Sensitive Layer

| | |
|---|---|
| Gelatin | 1.629 |
| Blue Sensitive Silver | 0.322 |
| Y-2 | 0.484 |
| ST-3 | 0.255 |
| Tributyl citrate | 0.141 |
| Poly(N-tert-butylacrylamide) | 0.484 |

SY-1: Enhancer Layer

| | |
|---|---|
| Gelatin | 0.323 |
| Y-1 | 0.194 |
| ST-1 | 0.033 |
| ST-2 | 0.011 |
| Diundecyl phthalate | 0.085 |

IL-1: Interlayer

| | |
|---|---|
| Gelatin | 0.753 |
| 2,5-Di-tert-octyl hydroquinone | 0.066 |
| Dibutyl phthalate | 0.188 |
| Disodium 4,5 Dihydroxy-m-benzenedisulfonate | 0.065 |
| Irganox 1076 ™ | 0.010 |

GL-1: Green Sensitive Layer

| | |
|---|---|
| Gelatin | 1.340 |
| Green Sensitive Silver | 0.104 |
| M-1 | 0.225 |
| Dibutyl phthalate | 0.080 |
| ST-4 | 0.061 |
| ST-5 | 0.171 |
| ST-6 | 0.571 |

GL-2: Green Sensitive Layer

| | |
|---|---|
| Gelatin | 1.340 |
| Green Sensitive Silver | 0.130 |
| M-1 | 0.225 |
| Dibutyl phthalate | 0.080 |
| ST-4 | 0.061 |
| ST-5 | 0.171 |
| ST-6 | 0.571 |

UV IL-1: UV Interlayer

| | |
|---|---|
| Gelatin | 0.712 |
| UV-1 | 0.030 |
| UV-2 | 0.172 |
| 2,5-Di-tert-octyl hydroquinone | 0.055 |
| Dibutyl phthalate | 0.034 |
| 1,4-Cyclohexylenedimethylene bis(2-ethylhexanoate) | 0.034 |

RL-1 Red Sensitive Layer

| | |
|---|---|
| Gelatin | 1.338 |
| Red Sensitive Silver | 0.211 |
| C-1 | 0.381 |
| Dibutyl phthalate | 0.373 |
| UV-2 | 0.246 |
| 2-(2-butoxyethoxy)ethyl acetate | 0.031 |
| 2,5-Di-tert-octyl hydroquinone | 0.003 |
| Potassium tolylthiosulfonate | 0.003 |
| Potassium tolylsulfinate | 0.0003 |

-continued

RL-2 Red Sensitive Layer

| | |
|---|---|
| Gelatin | 1.338 |
| Red Sensitive Silver | 0.264 |
| C-1 | 0.381 |
| Dibutyl phthalate | 0.373 |
| UV-2 | 0.246 |
| 2-(2-butoxyethoxy)ethyl acetate | 0.031 |
| 2,5-Di-tert-octyl hydroquinone | 0.003 |
| Potassium tolylthiosulfonate | 0.003 |
| Potassium tolylsulfinate | 0.0003 |

UV-1: UV Overcoat

| | |
|---|---|
| Gelatin | 0.537 |
| UV-1 | 0.023 |
| UV-2 | 0.130 |
| 2,5-Di-tert-octyl hydroquinone | 0.042 |
| Dibutyl phthalate | 0.025 |
| 1,4-Cyclohexylenedimethylene bis(2-ethylhexanoate) | 0.025 |

TEL-1: Tone Enhancing Layer

| | |
|---|---|
| Gelatin | 0.537 |
| UV-1 | 0.023 |
| UV-2 | 0.130 |
| 2,5-Di-tert-octyl hydroquinone | 0.042 |
| Titanium Dioxide | 0.269 |
| Dibutyl phthalate | 0.025 |
| 1,4-Cyclohexylenedimethylene bis(2-ethylhexanoate) | 0.025 |

TEL-2: Tone Enhancing Layer

| | |
|---|---|
| Gelatin | 0.537 |
| UV-1 | 0.023 |
| UV-2 | 0.130 |
| 2,5-Di-tert-octyl hydroquinone | 0.042 |
| Titanium Dioxide | 0.538 |
| Dibutyl phthalate | 0.025 |
| 1,4-Cyclohexylenedimethylene bis(2-ethylhexanoate) | 0.025 |

TEL-3: Tone Enhancing Layer

| | |
|---|---|
| Gelatin | 0.537 |
| 2,5-Di-tert-octyl hydroquinone | 0.042 |
| Titanium Dioxide | 0.538 |
| Dibutyl phthalate | 0.120 |
| Irganox 1076 ™ | 0.006 |

SOC-1: SOC

| | |
|---|---|
| Gelatin | 1.076 |
| 2,5-Di-tert-octyl hydroquinone | 0.013 |
| Dibutyl phthalate | 0.039 |
| SF-1 | 0.009 |
| SF-2 | 0.004 |
| Polystyrene Matte Beads (2.5 □m average diameter) | 0.013 |
| Dye-1 | 0.011 |
| Dye-2 | 0.004 |
| Dye-3 | 0.009 |

SOC-2: SOC

| | |
|---|---|
| Gelatin | 1.076 |
| 2,5-Di-tert-octyl hydroquinone | 0.013 |
| Dibutyl phthalate | 0.039 |
| SF-1 | 0.009 |
| SF-2 | 0.004 |
| Polystyrene Matte Beads (2.5 □m average diameter) | 0.125 |

SOC-3: SOC

| | |
|---|---|
| Gelatin | 1.076 |
| 2,5-Di-tert-octyl hydroquinone | 0.013 |
| Dibutyl phthalate | 0.039 |
| SF-1 | 0.009 |
| SF-2 | 0.004 |
| Polystyrene Matte Beads (2.5 □m average diameter) | 0.125 |
| Dye-4 | 0.054 |
| Dye-5 | 0.108 |

SOC-4: SOC

| | |
|---|---|
| Gelatin | 1.076 |
| 2,5-Di-tert-octyl hydroquinone | 0.013 |
| Dibutyl phthalate | 0.039 |
| SF-1 | 0.009 |

-continued
| | |
|---|---|
| SF-2 | 0.004 |
| Polystyrene Matte Beads (2.5 □m average diameter) | 0.125 |
| Titanium Dioxide | 1.076 |
| SOC-5: SOC | |
| Gelatin | 1.076 |
| 2,5-Di-tert-octyl hydroquinone | 0.013 |
| Dibutyl phthalate | 0.039 |
| SF-1 | 0.009 |
| SF-2 | 0.004 |
| Polystyrene Matte Beads (2.5 □m average diameter) | 0.125 |
| Dye-4 | 0.054 |
| Dye-5 | 0.108 |
Y-1
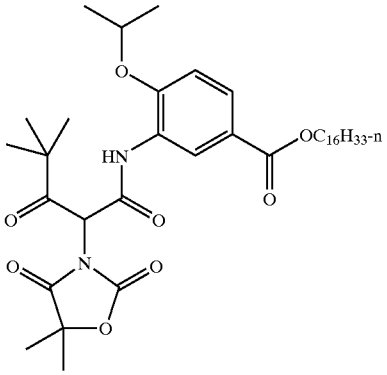
Y-2
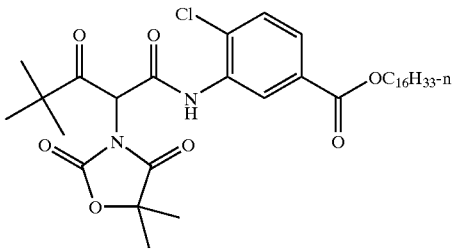
M-1
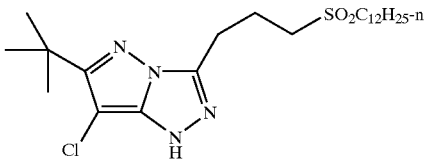
C-1
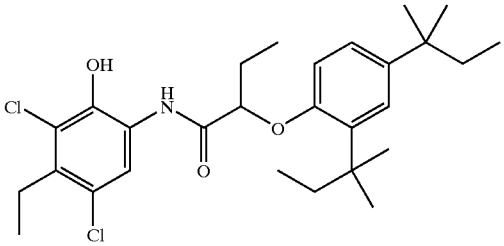
ST-1
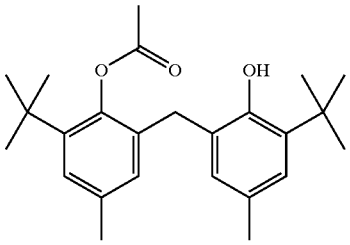
ST-2
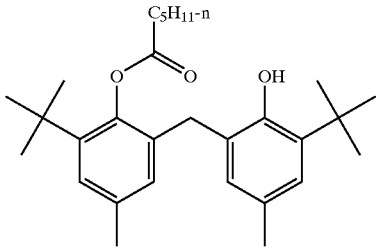
ST-3
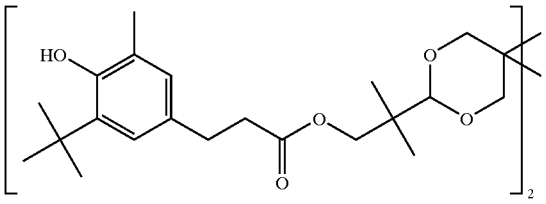
ST-4
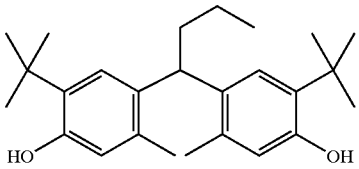
ST-5
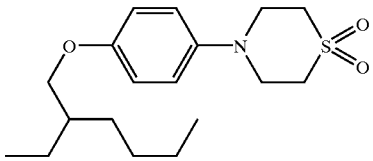
ST-6
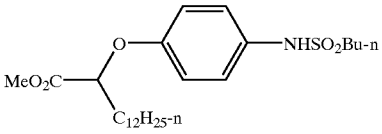
DYE-1
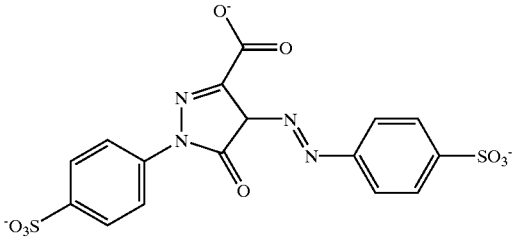

-continued

DYE-2

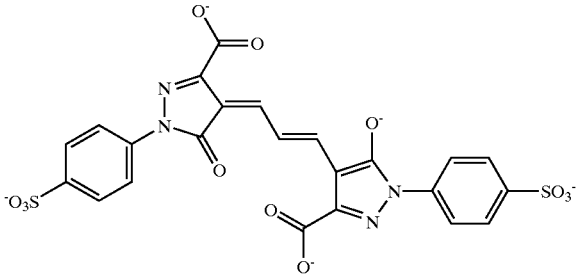

DYE-3

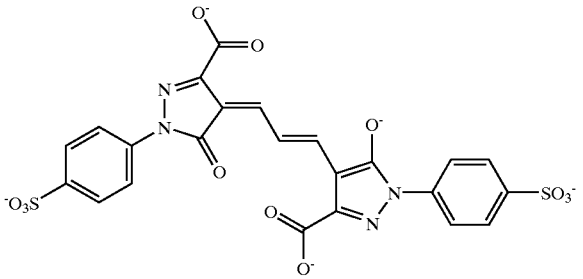

UV-1

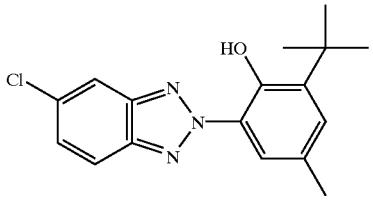

UV-2

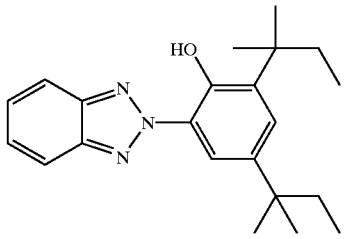

SF-1

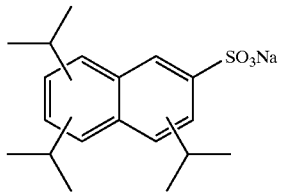

SF-2

$CF_3 \cdot (CF_2)_7 \cdot SO_3Na$

Prior art coating structure 2-1 has been shown to be inadequate because of uneven density (density change of 0.7 corresponding to the areas of the print platen in photographic printers) obtained when exposed in devices that have uncontrolled backscatter, such as due to a shiny platen behind the photographic media. When an antihalation layer was added to the structure (example 2-2) to reduce the uneven density corresponding areas of the print platen, the upper scale density was profoundly reduced. The addition of the invention tone enhancing layer (example 2-3) alone resulted in higher upper scale density (see 2-3) which provides much improved transmission image quality. The use of the tone enhancing layer in combination with the antihalation layer provides a means to recover upper scale density and provides robustness during image printing regardless of potential backscatter found in the printer design or through wear.

The polyester base containing the clay layer in combination with the silver halide tone enhancing layer and antihalation layer allows for better illumination of the front image without the backlight source showing through the duplitized support compared to prior art voided polyolefin supports. Further, the polyester base containing the clay layer also allows more exposure light energy to expose the backside image compared to a voided polyolefin sheet, thus allowing for more density to be developed on the backside image (the 7% transmission difference between the invention and the control resulted in a 0.3 increase in backside density). More backside density creates a higher quality image in transmission. The clay diffuser layer has also been shown not to scatter laser exposure energy allowing the top and bottom image to be simultaneously exposed and be in registration front to back, a distinct advantage of the clay diffuser compared to inorganic light diffusers such as $TiO_2$.

Finally, because of the duplitized light sensitive silver halide coating, the invention had a developer time of 45 seconds. compared to a developer time of 110 seconds for prior art transmission display materials, as prior art materials used heavy coverage on just the topside. A 45 second developer time has significant commercial value in that the display material of this invention can increase the productivity of expensive processing equipment.

The invention has been described in detail with particular reference to certain preferred embodiments thereof, but it will be understood that variations and modifications can be effected within the spirit and scope of the invention.

What is claimed is:

1. An imaging member comprising at least one duplitized imaging layer and a non-voided support, wherein said non-voided support comprises at least one layer comprising a polymeric resin matrix and an inorganic particle having an aspect ratio of at least 10 to 1, a lateral dimension of from 0.01 $\mu$m to 5 $\mu$m, and a vertical dimension from 0.5 nm to 10 nm, and wherein said non-voided support comprises a top surface and a bottom surface, wherein said duplitized imaging layer comprises a top imaging layer on said top surface of said support and a bottom imaging layer on said bottom surface of said support.

2. The imaging member of claim 1 further comprising an antihalation layer.

3. The imaging member of claim 1 wherein said at least one layer comprising inorganic particles and polymeric resin matrix comprises at least one sheet.

4. The imaging member of claim 1 wherein said at least one layer comprising inorganic particles and polymeric resin matrix comprises an extrusion coated layer.

5. The imaging member of claim 1 wherein said inorganic particles comprise organically modified inorganic particles.

6. The imaging member of claim 5 wherein said organically modified inorganic particle comprises a splayed particle.

7. The imaging element of claim 6 wherein said splayed particle is exfoliated.

8. The imaging element of claim 6 wherein said splayed particle is intercalated.

9. The imaging member of claim 1 wherein said inorganic particles comprise from 2 to 15 parts by weight of said at least one layer comprising inorganic particles and resin.

10. The imaging member of claim 1 wherein said inorganic particles comprise from 5 to 10 parts by weight of said at least one layer comprising inorganic particles and resin.

11. The imaging member of claim 1 wherein said at least one layer comprising inorganic particles and resin comprises a polyester resin.

12. The imaging member of claim 1 wherein said support comprises one layer.

13. The imaging member of claim 1 wherein said resin is selected from the group consisting of polyolefin, polyester, polyamide, polystyrene, and polyurethane.

14. The imaging member of claim 1 wherein said image layer comprises at least one layer containing photosensitive silver halide.

15. The imaging member of claim 1 wherein said image layer comprises at least one layer containing ink jet receiving material.

16. The imaging member of claim 1 wherein said image layer comprises at least one layer containing thermal dye receiving material.

17. The imaging member of claim 1 wherein said inorganic particle comprises layered material.

18. The imaging member of claim 17 wherein said layered material comprises clay particles.

19. The imaging member of claim 18 wherein said clay particles comprise smectite.

20. The imaging member of claim 19 wherein said smectite clay particles comprise montmorillonite.

21. The imaging member of claim 1 wherein said inorganic particles comprise hydrotalcite.

22. The imaging member of claim 1 wherein said inorganic particles comprise mica.

23. The article of claim 17 wherein said layered material comprises Ag-doped vanadium pentoxide.

24. The article of claim 17 wherein said layered material comprises a non-clay.

25. The article of claim 17 wherein said layered material comprises $FeCl_3$, FeOCl, $TiS_2$, $MoS_2$, $MoS_3$, $Ni(CN)_2$, $H_2Si_2O_5$, $V_6O_{13}$, $HTiNbO_5$, $Cr_{0.5}V_{0.5}S_2$, $V_2O_5$, $W_{0.2}V_{2.8}O7$, $Cr_3O_8$, $MoO_3(OH)_2$, $VOPO_4$-$2H_2O$, $CaPO_4CH_3$—$H_2O$, $MnHAsO_4$—$H_2O$, or $Ag_6Mo_{10}O_{33}$.

26. The imaging member of claim 1 wherein said member comprises a transparency of from 30 to 70% light transmission.

27. The imaging member of claim 1 wherein said member comprises a transparency of from 45 to 55% light transmission.

28. The imaging member of claim 1 wherein said support is viewed in both reflection and transmission.

29. The imaging member of claim 1 further comprising at least one skin layer between said imaging layer and said support.

30. The imaging member of claim 1 further comprising an adhesion layer between said imaging layer and said support.

31. The imaging member of claim 1 further comprising a tone enhancing layer.

* * * * *